United States Patent [19]

Kuwahara et al.

[11] Patent Number: 5,042,533

[45] Date of Patent: Aug. 27, 1991

[54] AUTO-DOFFER FOR LOOMS IN A WEAVING MILL

[75] Inventors: Shoichi Kuwahara; Hideho Kyoda, both of Ishikawa, Japan

[73] Assignee: Tsudakoma Kogyo Kabushiki Kaisha, Japan

[21] Appl. No.: 411,315

[22] Filed: Sep. 22, 1989

[30] Foreign Application Priority Data

| | | | |
|---|---|---|---|
| Sep. 22, 1988 | [JP] | Japan | 63-239161 |
| Sep. 22, 1988 | [JP] | Japan | 63-239162 |
| Sep. 26, 1988 | [JP] | Japan | 63-242116 |
| Sep. 28, 1988 | [JP] | Japan | 63-245553 |
| Oct. 3, 1988 | [JP] | Japan | 63-250547 |
| Oct. 13, 1988 | [JP] | Japan | 63-259199 |
| Oct. 13, 1988 | [JP] | Japan | 63-259200 |
| Oct. 17, 1988 | [JP] | Japan | 63-262653 |
| Nov. 4, 1988 | [JP] | Japan | 63-278808 |

[51] Int. Cl.[5] ..... D03D 49/00

[52] U.S. Cl. ..... 139/1 R; 139/291 C; 414/911

[58] Field of Search ..... 242/58.3, 56 R, 66; 414/911, 458; 28/208; 139/1 R, 291 C, 304

[56] References Cited

U.S. PATENT DOCUMENTS

| | | | |
|---|---|---|---|
| 4,091,939 | 5/1978 | Shimizu et al. | 414/911 X |
| 4,606,381 | 8/1986 | Suwa et al. | 139/1 R |
| 4,609,162 | 9/1986 | Kataoka | 242/56 R |
| 4,651,942 | 3/1987 | Tomma | 242/56 R |
| 4,892,119 | 1/1990 | Hugo et al. | 139/1 R |
| 4,910,837 | 3/1990 | Fujimoto et al. | 139/1 R |

FOREIGN PATENT DOCUMENTS

| | | | |
|---|---|---|---|
| 62-266809 | 8/1987 | Japan | 139/1 R |
| 62-215403 | 9/1987 | Japan . | |

*Primary Examiner*—Andrew M. Falik

*Attorney, Agent, or Firm*—Ostrolenk, Faber, Gerb & Soffen

[57] ABSTRACT

In construction of an auto-doffer for weaving looms, a pair of arm mounted to a carriage carry out full automatic doffing separation by means of their three dimensional movement and a cutter unit also mounted to the carriage disconnects, in cooperation with a cloth pressor unit, a full roll held by the arms from a cloth being woven. The carriage is designed to travel along selected paths in a weaving mill to visit a loom in need of doffing operation on receipt of a command from a central processing unit. After the doffing operation, the auto-doffer carrying a full roll travels to a station aranged in the mill for transfer of the full roll to and receipt of an empty roll from a transporter which reciprocate between the station and a cloth roll stocker.

46 Claims, 31 Drawing Sheets

AUTO-DOFFER FOR LOOMS IN A WEAVING MILL

BACKGROUND OF THE INVENTION

The present invention relates to an auto-doffer for looms in a weaving mill, and more particularly relates to full automatization of doffing operation of cloths on a loom in a weaving mill wherein a large number of looms are collectively arranged for production of woven cloths.

In doffing operation on a loom, a cloth connected to a full roll on the loom is cut in the width direction for disconnection from a cloth being woven and the full roll is doffed off the loom onto a carriage. Next, an empty roll carried to the loom by a carriage is transferred to the loom and the leading end of the cloth being woven is wound around the empty roll so transferred.

Such a series of operation steps are conventionally carried out by means of manual labour by mill operators. With recent increase in width of a loom, the weight of a cloth roll is increased significantly and, as a result, it is currently almost infeasible to carry out the doffing operation by manual labour. In addition, the loom needs to be kept inoperative for a considerably long period for such manual doffing operation. With recent, general tendency of high speed running of looms, production loss caused by such long stoppage of the loom becomes quite significant. Because of such a recent trend in production, there has appeared a strong demand for automatic doffing operation.

Several attempts have been made to automate the doffing operation to satisfy such a demand. For example, Japanese Patent Opening Sho. 60-171956 proposes an automatic doffing system. Most conventional proposals, however, are involved in partial automation of the entire doffing operation only. Some of the conventional attempts propose fully automatic doffing systems but, as far as generally known by ones skilled in the art, they are rather theoretical than practical. In other words, no fully automatized doffing systems have been used in practice.

SUMMARY OF THE INVENTION

It is the basic object of the present invention to provide a fully automatized doffing system quite suited for practical use in a production mill.

In accordance with the basic aspect of the present invention, a carriage is designed to travel along a selected path in a weaving mill and to stop in front of an appointed loom in need of doffing operation, a main shaft is arranged on the carriage and extends horizontally in the direction of travel of the carriage, a pair of arms are mounted radially to the main shaft and each provided with a pair of co-operative fingers for holding a roll, an arm drive unit is mounted to the carriage in mechanical coupling with the arms to cause three dimensional movements of the arms, a cloth presser unit is mounted to the carriage and provided with a press roller adapted for pressing a cloth onto an empty roll is position, and a cutter unit is mounted to the carriage and provided with a cutter for cutting the cloth between the empty roll and a full roll.

DESCRIPTION OF THE PREFERRED EMBODIMENTS

General Construction and Operation

Figure 1:
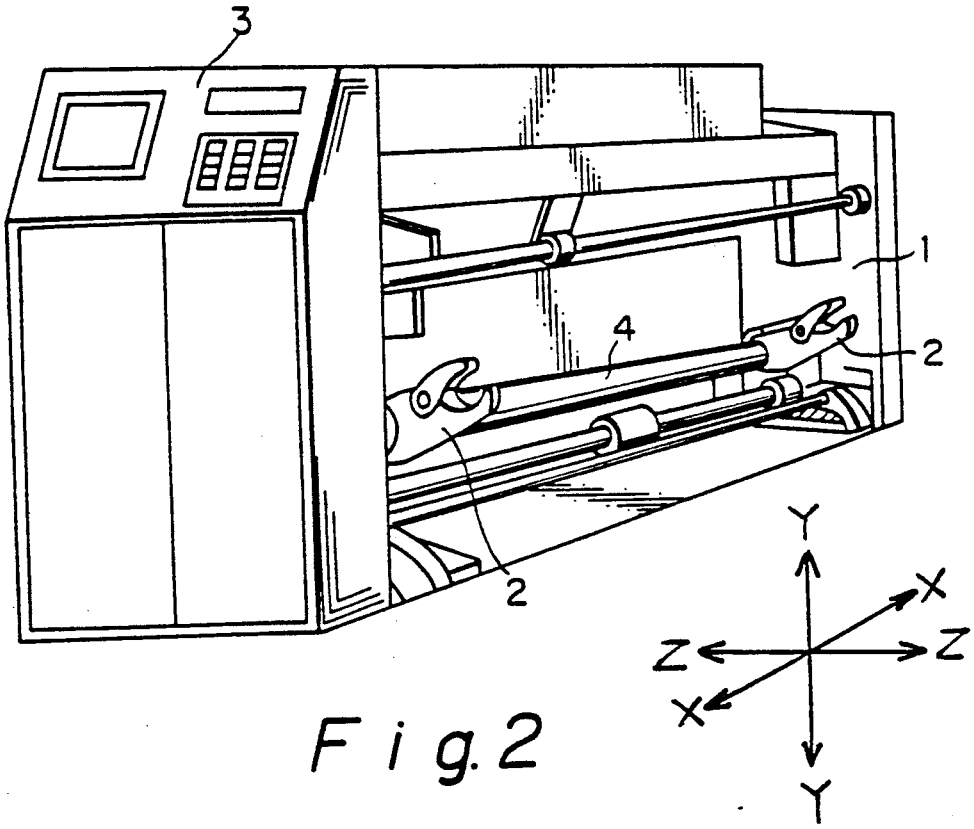
FIG. 1 is a perspective view of the entire construction of the auto-doffer in accordance with the present invention.

The entire construction of the auto-doffer in accordance with the present invention is shown in FIG. 1, in which most parts of the auto-doffer are mounted on a carriage which, as is well known in the art along a selected path in a weaving mill.

Figure 2:
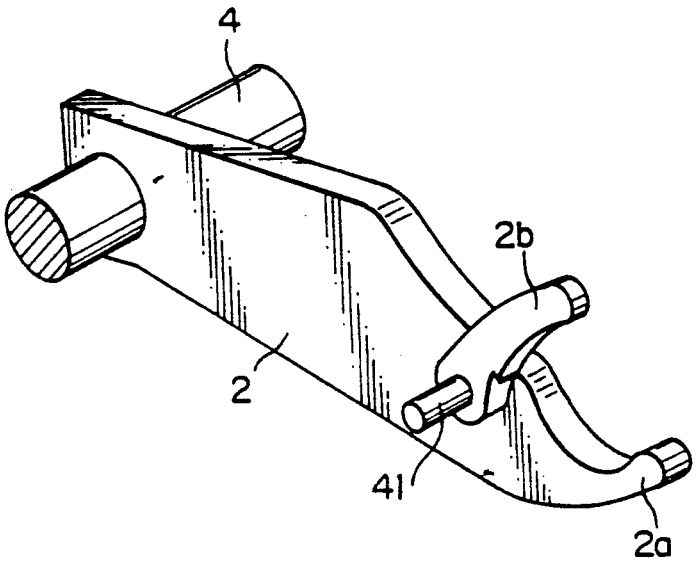
FIG. 2 is a perspective view of an arm of the auto-doffer shown in FIG. 1.

In the lower part of a carriage frame 1 is arranged a main shaft 4 which extends horizontally in the width direction of the carriage. The carriage is designed to travel in the width direction which is parallel to the width direction of each loom (not shown). A pair of arms 2 such as shown in FIG. 2 are mounted to the main shaft 4 near its longitudinal ends. Each arm 2 is fixed at the proximal end to the main shaft 4 and provided at the distal end with stationary and movable fingers 2*a* and 2*b*. The movable finger 2*b* is pivoted to the arm 2 via a pin 41 projecting from the side face of the arm 2. The fingers 2*a* and 2*b* cooperate to hold a roll in between.

As later explained in more detail, the arm 2 is driven for three dimensional movement. That is, the arm 2 moves in the width direction of the carriage and this direction of movement will hereinafter be referred to as the "X-direction". The arm 2 also moves in a horizontal direction perpendicular to the width direction of the carriage and this direction of movement will hereinafter be referred to as the "Z-direction". The arm 2 further swings in the vertical direction and this direction of movement will hereinafter be referred to as the "Y-direction". A control panel 3 is arranged on one side end of the auto-doffer for control of various operations of various elements.

Figure 3:
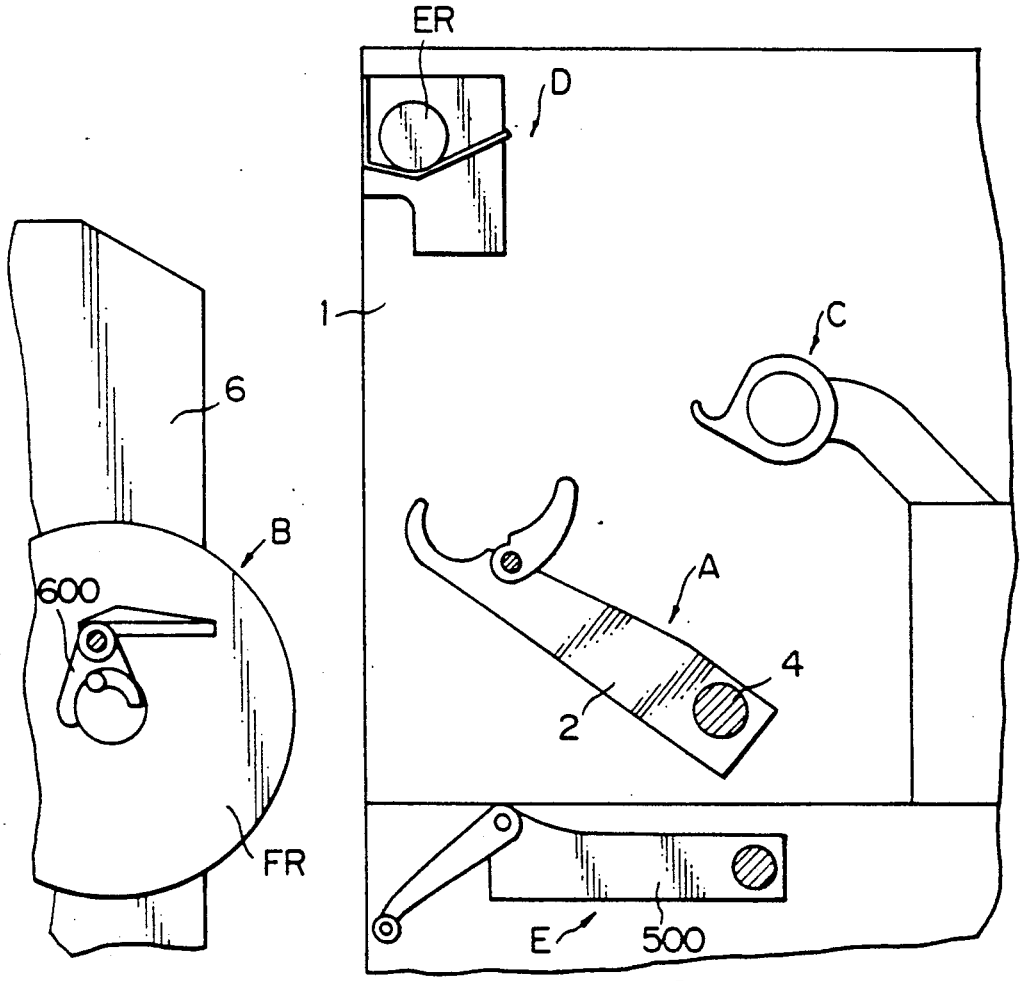
FIG. 3 is a simplified side view of the auto-doffer.

Next, the operation of the auto-doffer of the above-described construction will be roughly explained in reference to FIG. 3. In the illustration, A indicates a stand-by position of the arm 2 on the auto doffer, B indicates a locking position on the loom whereat a full roll FR is held, C indicates a full roll station on the auto-doffer adapted for receiving a full roll carried by the arms 2, D indicates an empty roll station adapted for reserving an empty roll to be transferred to the loom, and C indicates a stand-by position of the presser unit.

The entire operation of the auto-doffer in accordance with the present invention includes the following operational steps.

(i) The carriage stops in front of a loom in need of doffing operation. The arms 2 are registered at the stand-by position A and the fingers 2*a* and 2*b* are open.

(ii) The arms 2 move forwards and downwards.

(iii) The arms 2 move upwards for engagement with the lock unit 600 on the loom 6 at the locking station B. After receipt of a full roll FR, the fingers 2*a* and 2*b* are closed.

(iv) The arms 2 move rearwards and upwards.

(v) A gear of the full roll FR held by the arms 2 comes in engagement with a drive gear on the carriage and the fingers 2*a* and 2*b* are opened to transfer the full roll FR to the full roll station C on the carriage.

(vi) The arms 2 moves forwards and downwards towards a position below the empty roll station D on the carriage.

(vii) An empty roll ER is transferred to the arms 2 from the empty roll station D and the fingers 2*a* and 2*b* are closed.

(viii) The arms 2 moves forwards and downwards again for engagement with the lock unit on the loom. The fingers 2*a* and 2*b* are opened to transfer the empty roll ER to the lock unit 600.

(ix) The arms 2 move rearwards and upwards towards the stand-by position A on the carriage.

(x) The press roller of the presser unit 500 moves forwards and upwards to clamp a cloth connected to the full roll FR at the full roll station C between itself and the lower face of the empty roll ER at the locking station B on the loom 6.

(xi) The cutter unit comes in engagement with the cloth so clamped and cuts the cloth transversely. After the free end of the cloth being woven is wound about the empty roll ER by operation of the presser unit 500, the cutter unit returns to its initial position.

(xii) The presser unit returns to the stand-by position E on the carriage.

Arm Drive Unit 50

This arm drive unit 50 is involved mainly in the above-described operational steps (ii) to (ix) and made up of a Z-drive assembly 10 for moving the arms 2 in the Z-direction, a Y-drive assembly 20 for moving the arms 2 in the Y-direction, an X-drive assembly 30 for moving the arms 2 in the X-direction and a finger manipulate assembly 40 for opening and closing the fingers 2*a* and 2*b* of each arm 2.

Figure 4:
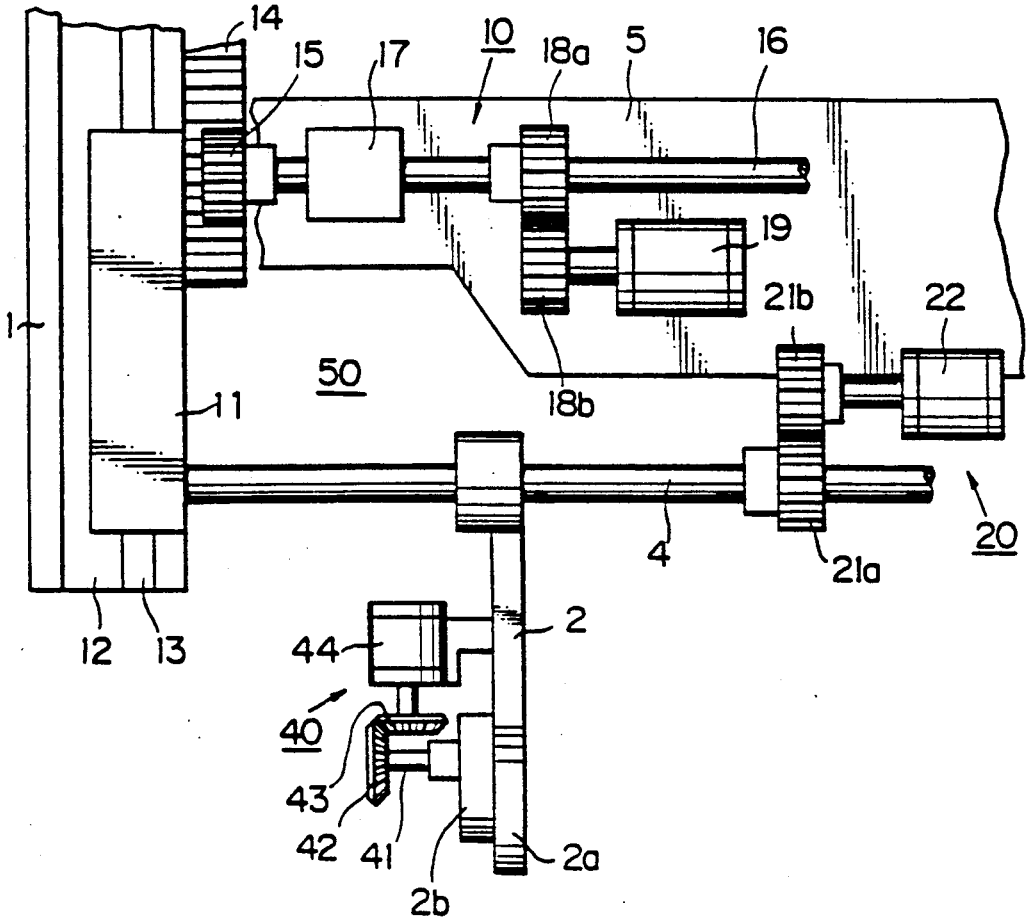
FIG. 4 is a plan view of one embodiments of the Z- and Y-direction drive assemblies.

One embodiment of the Z-drive assembly 10 is shown in FIG. 4, in which one of the arms 2 is fixed to the main shaft 4 at its proximal end. Only parts related to one end of the main shaft 4 is shown in the illustration. Preferably, the other end of the main shaft 4 should be accompanied with similar parts for a balanced operation. The one end of the main shaft 4 is rotatably mounted to a slide base 11 which is slidable in the Z-direction along a guide rail 13. This guide rail 13 is arranged, being elongated in the Z-direction, on a guide block 12 fixed on the carriage frame 1. The slide bases 11 on both ends of the main shaft 4 are firmly connected by a transverse, horizontal beam 5 so as to move in correct synchronism. A transmission shaft 16 is rotatably mounted to the beam 5 via brackets 17 and fixedly holds a pinion 15 at its longitudinal end. This pinion 15 is held in meshing engagement with rack 14 which extends in the Z-direction on the carriage frame 1. The transmission shaft 16 is coupled to a reversible drive motor 19 on the beam 5 via intermediate gears 18*a* and 18*b*.

As the drive motor 19 is activated, the pinion 15 is driven for rotation via the transmission shaft 16 and, due to the pinion-rack engagement, the slide base 11 moves in the Z-direction while accompanying movement of the arms 2 on the main shaft 4 in a same direction.

One embodiment of the Y-drive assembly 20 is also shown in FIG. 4, in which the main shaft 4 holding the arms 2 is also coupled to a reversible drive motor 22 on the beam 5 via intermediate gears 21*a* and 21*b*.

As the drive motor 22 is activated, the main shaft 4 rotates axially and the arms 2 swing up and down, i.e. in the Y-direction. Since the drive motor 22 is mounted to the beam 5, the drive motor 22 moves in the Z-direction as the arms 2 move in the Z-direction. As a result, there is no interference between the Y- and Z-movements of the arms 2.

Figure 5:
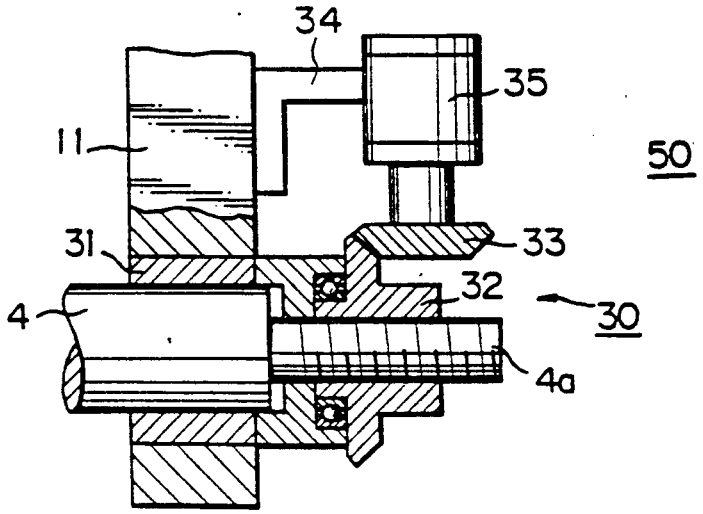
FIG. 5 is a side view, partly in section, of one embodiment of the X-drive assembly.

One embodiment of the X-drive assembly 30 is shown in FIG. 5, in which one end of the main shaft 4 is rotatably mounted to the slide base 11 via a bushing 31. This end of the main shaft 4 forms a threaded end 4*a* which is kept in meshing engagement with a bevel gear 32. This gear 32 is coupled to the bushing 31 via a bearing and also kept in mesh with another bevel gear 33 which is fixed to the output shaft of a reversible drive motor 35. This drive motor 35 is mounted to the slide base 11 via a bracket 34.

As the drive motor 35 is activated, the gear 32 is driven for rotation via the gear 33 and the main shaft 4 is moved in the X-direction, i.e. in the width direction of the carriage, due to engagement of the threaded end 4*a* with the gear 32. The X-drive assembly 30 as a whole is firmly connected to the slide base 11, and moves in the Z-Direction as the arms 2 move in that direction. In connection with this, the main shaft 4 rotates axially as the arms 2 swing in the Y-direction. The swing ambit of the arms 2 is, however, small than 180° and, as a consequence, the corresponding axial rotation of the main shaft 4 spans less than 180°. When the pitch of the threaded end 4*a* is chosen small and the amount of rotation of the drive motor 35 necessary for the X-direction movement of the main shaft 4 is chosen large, the X-direction movement of the main shaft 4 caused by the Y-direction movement of the arms 2 can be rendered negligibly small. So, there is no substantial problem in practice regarding this point of dual X-direction movement.

Figure 6:
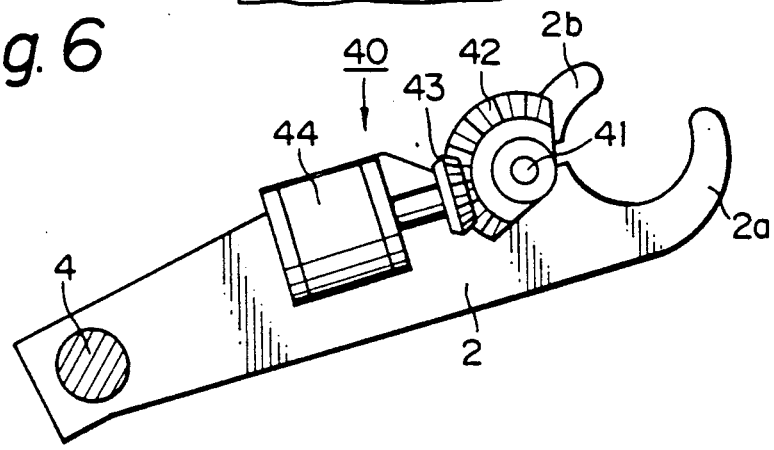
FIG. 6 is a side view of one embodiment of the finger control assembly.

One embodiment of the finger control assembly 40 is shown in FIGS. 4 and 6. As stated already, the movable finger 2*b* is pivoted to the arm 2 via the pin 41 projecting horizontally from the side face of the arm 2 and a gear 42 is fixedly mounted to the pin 41 and kept in meshing engagement with another gear 43 which is fixed to the output shaft of a reversible drive motor 44 mounted to the arm 2.

As the drive motor 44 is activated, corresponding rotation of the pin 41 causes swing motion of the movable finger 2*b* towards and away from the stationary finger 2*a*.

Empty Roll Doffing Unit 200

The auto-doffer in accordance with the present invention is preferably provided with an empty roll doffing unit 200 which is involved mainly in the above-described operational step (vii) and arranged at the empty roll station D shown in FIG. 3.

Figure 7:
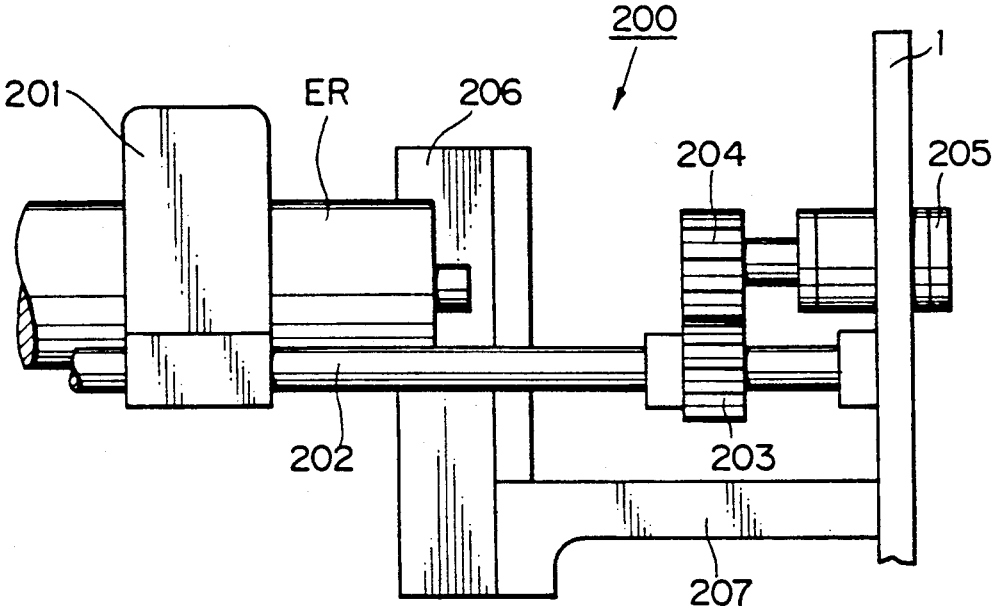
FIGS. 7 and 8 are plan and side views of one embodiment of the empty roll doffing unit preferably used for the auto-doffer shown in FIG. 1, FIGS. 9A to 9D are side views for showing the operation of the empty roll doffing unit.
Figure 8:
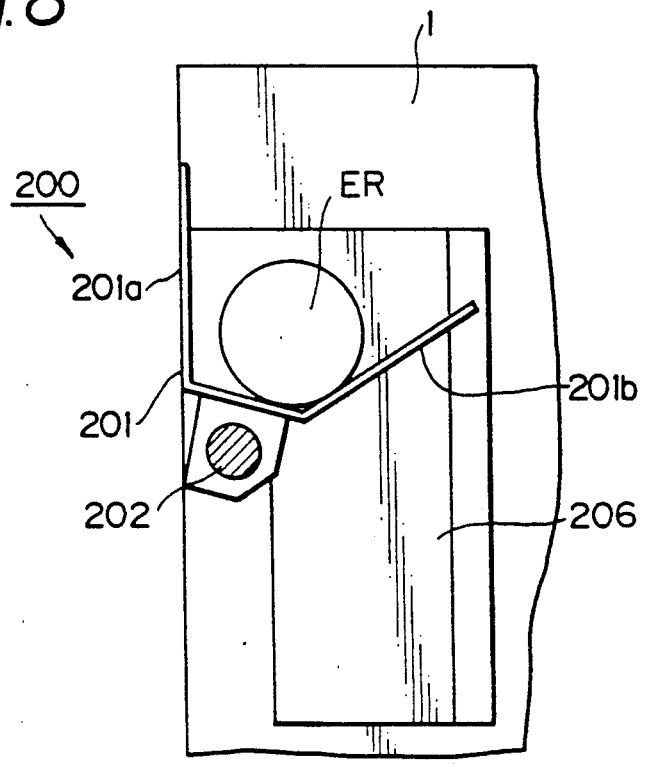

One embodiment of such an empty roll doffing unit 200 is shown in FIGS. 7 and 8. A holder plate 201 is made up of the first wall 201*a* and the second wall 201*b* connected in one body to each other in a V- or U-shape. The first and second walls 201*a* and 201*b* define an intervening space large enough to accommodate an empty roll ER therein. The holder plate 201 is secured to a horizontal support shaft 202 which is rotatably mounted to the carriage frame 1 and extends in the X-direction, i.e. the width direction of the carriage. A gear 203 secured to the support shaft 202 is kept in meshing engagement with an intermediate gear 204 secured to the output shaft of a reversible drive motor 205 which is mounted to the carriage frame 1. This drive motor 205 is electrically connected to a central processing unit (not shown) of the auto-doffer. Facing the holder plate 201 is a vertical guide wall 206 which is fixed to the carriage frame 1 via a bracket 207. As the drive motor 205 is activated, the holder plate 201 rotates in a vertical plane.

The operation of the empty roll doffing unit 200 will next be explained in reference to FIGS. 9A to 9D.

Figure 9A:
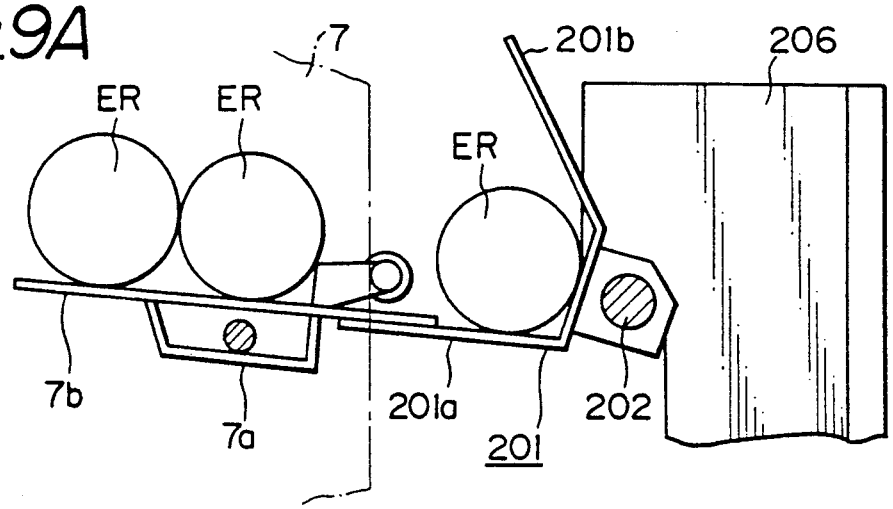

The carriage travels to an empty roll stacker 7 arranged at a proper location in the mill in order to receive an empty roll ER therefrom as shown in FIG. 9A. The empty roll stacker 7 is provided with a slightly sloped guide chute 7*b* on which several empty rolls ER are stored. The guide chute 7*b* is accompanied with a bottom pawl 7*a* which is driven for operation by a proper drive source not shown. By a vertical swing motion of the pawl 7*a*, successive empty rolls ER are separated from each other for individual transfer to the arms 2.

As the carriage arrives at the location of the empty roll stacker 7, rotation of the support shaft 202 registers the holder plate 201 at a position in which the first wall 201*a* assumes a substantially horizontal position in order to form a guide path for the empty roll ER in stand-by in cooperation with the guide chute 7*b* of the empty roll stacker 7. Thereupon, the pawl 7*a* is driven to chop below the guide chute 7*b* and, due to the sloped disposition of the guide chute 7*b*, the empty roll ER is automatically transferred to the holder plate 201 as shown in FIG. 9A. At this moment, the second wall 2*b* assumes an almost upright position to stop the empty roll ER transferred to the holder plate 201. To complete transfer of the empty roll ER, the support shaft 202 further rotates to make the first and second walls 201*a*, 201*b* be directed upwards to hold the empty roll ER in between.

Figure 9B:
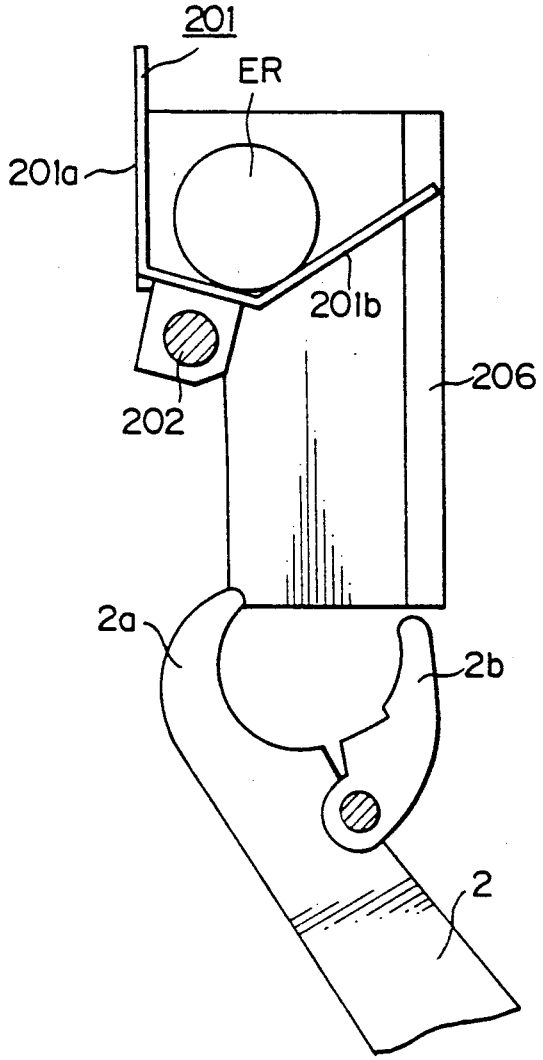

The carriage then travels to a position in front of an appointed loom in need of doffing operation and stops thereat. In the meantime, the arms 2 move forwards and upwards from the stand-by position A in FIG. 3 to come to a position just below the empty roll doffing unit 200 as shown in FIG. 9B.

Figure 9D:
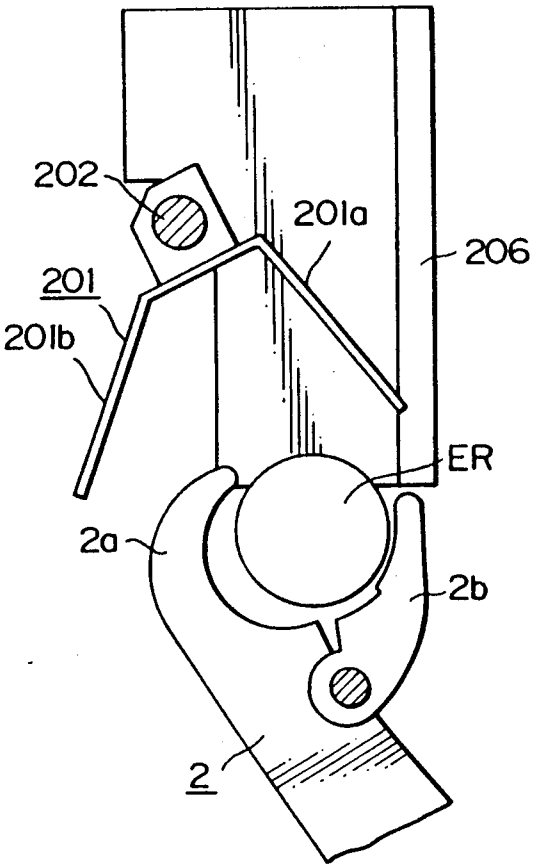
Figure 9C:
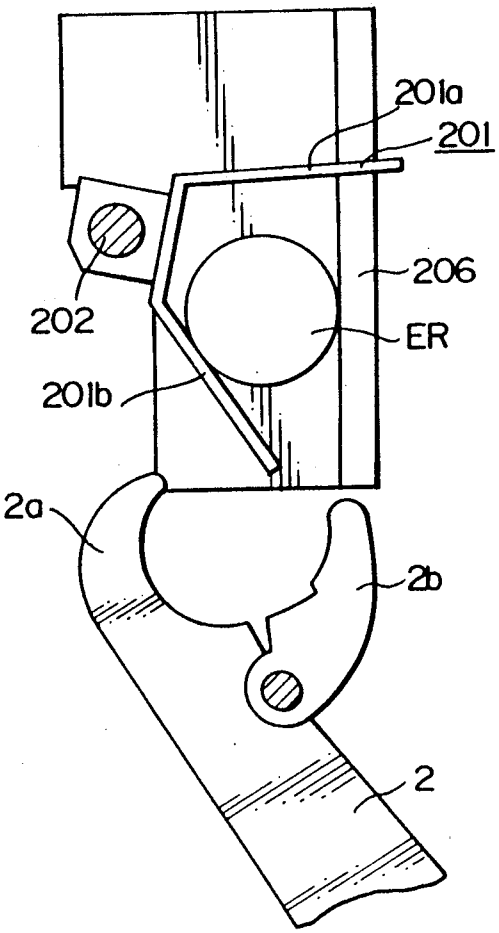

The support shaft 202 further rotates to make the first and second walls 201*a*, 201*b* be gradually directed downwards as shown in FIG. 9C. With increasing downward inclination of the second wall 201*b*, the empty roll ER bears on the second wall 201*b* and becomes provisionally held between the second wall 201*b* of the holder pate 201 and the guide wall 206 on the carriage frame 1. As a clearance between the two walls 201*b* and 206 becomes larger, the empty roll ER moves downwards and, when the clearance exceeds the diameter of the empty roll ER, the empty roll ER falls into a space between the fingers 2*a* and 2*b* of each arm 2 due to its own weight as shown in FIG. 9D. Then the fingers 2*a* and 2*b* are closed to firmly hold the empty roll ER therebetween. Thus, transfer of the empty roll ER is terminated. It should be appreciated that the cooperation of the holder plate 201 with the guide wall 206 assures stable and reliable transfer of each empty toll ER to the arms 2.

Arm Movement Adjuster Unit 100

The auto-doffer in accordance with the present invention is preferably provided with an arm movement adjuster unit 100 in combination with the above-described arm drive unit 50.

The doffing operation of the auto-doffer in accordance with the present invention is carried out mainly by the arms 2 and greatly related to the stop position of the carriage with respect to an appointed loom in need of the doffing operation.

As shown in FIG. 1, the carriage is a mobile body of a large construction and, as a consequence, its movement is accompanied with large inertia. Due to presence of such a large inertia, it is quite infeasible to stop the carriage always exactly at a correct position with respect to a loom. Movements of each arm are carried out in two modes. In the first mode, its movements are designed in reference to a standard point on the carriage and this point is hereinafter referred to as the "carriage standard". Whereas, in the second mode, its movements are designed in reference to a standard point on the loom and this point is hereinafter referred to as the "loom standard".

Variation in stop position of the carriage has no influence on the movements of the carriage standard but causes a serious problem in the case of the movements of the loom standard. When a difference between the two standards is constant, the initial compensation solves the problem quite easily. In practice, however, the stop position of the carriage with respect to a loom varies from time to time. In other words variation in difference between the two standards must be always taken into consideration in order to design the movements of the loom standard correctly so that the difference between the two standards should be compensated at every stoppage of the carriage by corresponding automatic adjustment of the movements of the arms 2. The arm movement adjuster unit 100 is used to satisfy such a requirement in practice.

Figure 11:
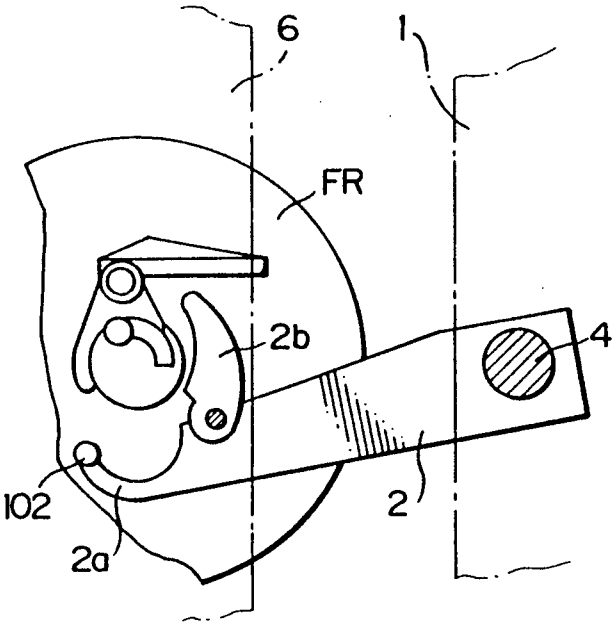
FIG. 11 is a side view of the arm at detection of distance by the arm movement adjuster unit shown in FIG. 10.
Figure 10:
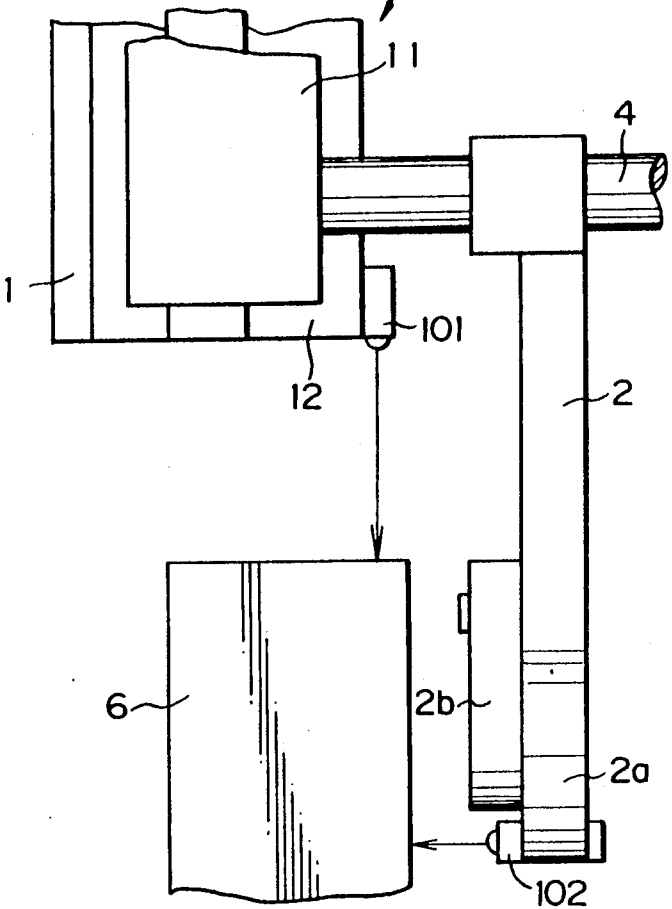
FIG. 10 is a plan view of one embodiment of the arm movement adjuster unit preferably used for the auto-doffer shown in FIG. 1.
Figure 12:
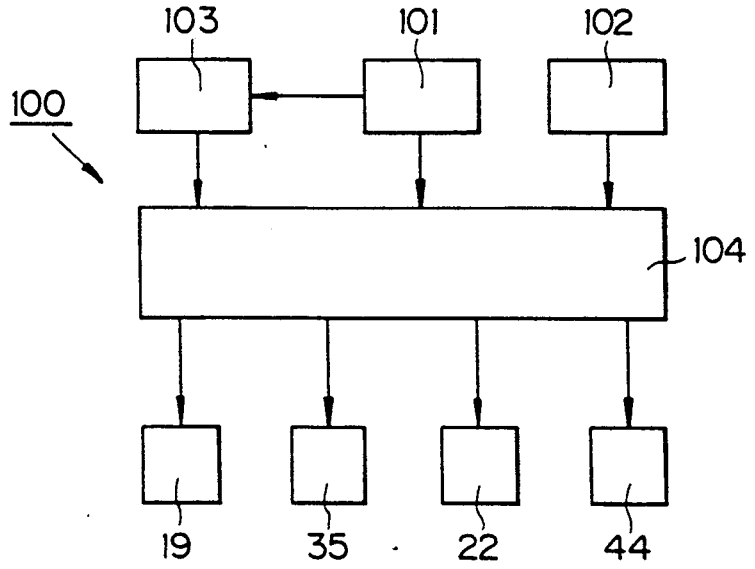
FIG. 12 is a diagram of the electric system for processing detection signals in the adjuster unit shown in FIG. 10.

One embodiment of such an arm movement adjuster unit 100 is shown FIGS. 10 to 12. In FIG. 10 a Z-direction detector 101 is mounted to the front end of the guide block 12 of the arm drive unit 50 while being directed in the Z-direction and an X-direction detector 102 is mounted to the distal end of the stationary finger 2*a* of the arm 2 fixed to the main shaft 4 and is directed in the X-direction. The detectors 101 and 102 are non-contact type detectors such as photoelectric detectors.

As the carriage stops in front of a loom 6, the Z-direction detector 101 detects the distance in the Z-direction between the carriage and the loom 6 to issue a detection signal. As the arm 2 moves forwards and downwards from the stand-by position in FIG. 3 to a position shown in FIG. 11, the X-direction detector 102 detects the distance in the X-direction between the carriage and the loom 6 to issue a detection signal. This detection can be carried out not only at the position shown in FIG. 11 but also at any positions at which the loom generated by the X-direction detector 102 is interrupted by the loom 6.

As shown in FIG. 12, the detectors 101 and 102 are electrically connected to the central processing unit 104 of the auto-doffer. In the case of the illustrated example, a timing pulse generator 103 is also electrically connected to the Z-direction detector and the central processing unit 104. On the output side, the central processing unit 104 is electrically connected to the drive motors 19, 22, 35 and 34 of the arm drive unit 50.

The detection signal from the Z-direction detector 101 is passed to the central processing unit 104 and, concurrently to the timing pulse generator 103 which thereupon starts to generate a series of timing pulses for operation of the central processing unit 104. Then, the detection signal from the X-direction detector 102 is also passed to the central processing unit 104. On the basis of these detection signals, the central processing unit 104 issues Z- and X-directions command signals corresponding to the current differences between the carriage and loom standards. The Z-direction command signal is passed to the drive motor 19 of the Z-drive assembly 10 shown in FIG. 4 where as the X-direction command signal is passed to the drive motor 35 of the X-drive assembly 30 shown in FIG. 5. These command signals induce corresponding movements of the arms 2 adjusted so as to offset the above-described current differences between the carriage and loom standards. Thus, the arms 2 are always driven into correct three dimensional movements regardless of the presence of the difference in standard. When there is a difference in standard in the Y-direction, a Y-direction detector may be additionally used in a same way.

CLOTH PRESSER UNIT 500

The cloth presser unit 500 is involved mainly in the above-described operational steps (x) to (xii) and operates mainly at the locking station B shown in FIG. 3.

Figure 13:
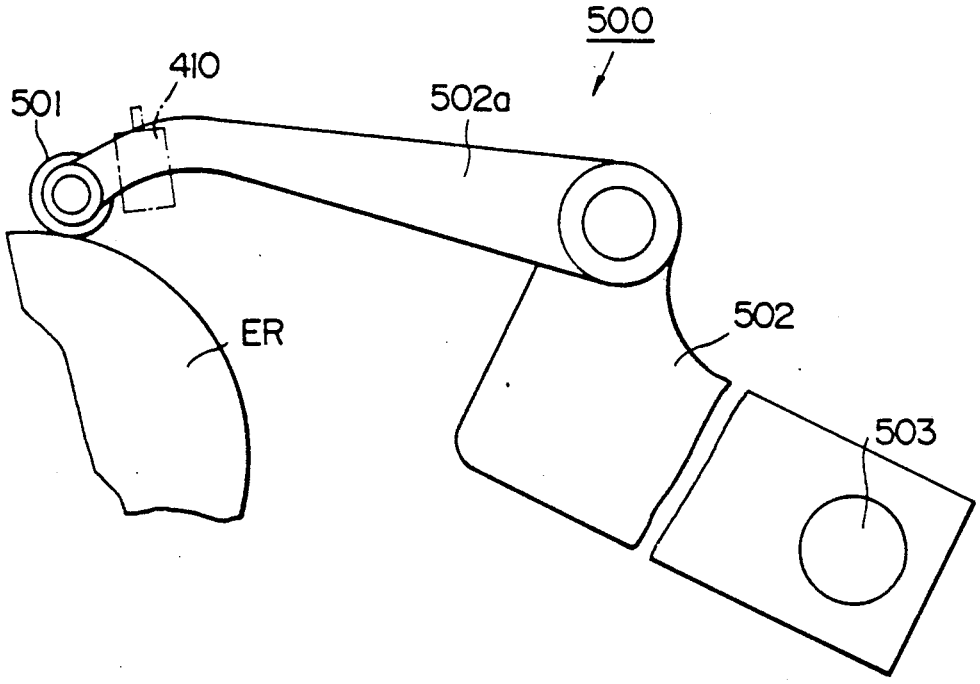
FIG. 13 is a side view of an embodiment of the cloth presser unit.
Figure 14:
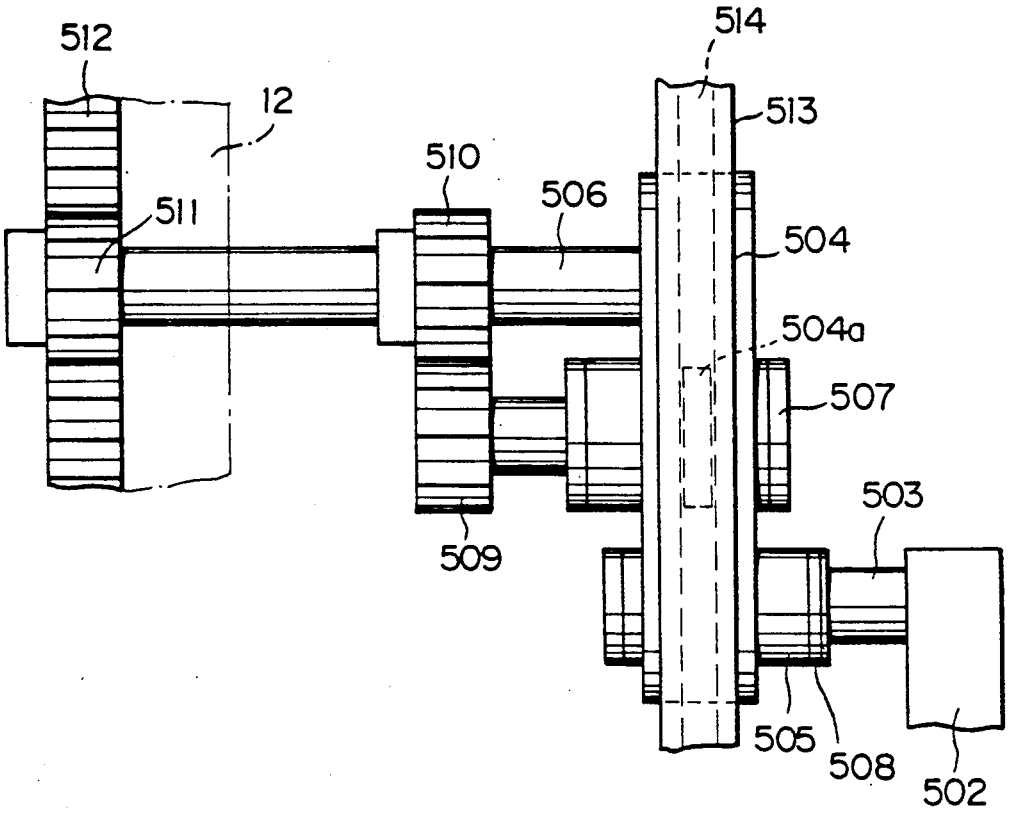
FIGS. 14 and 15 are plan and side views of a driving system for the cloth presser unit.
Figure 15:
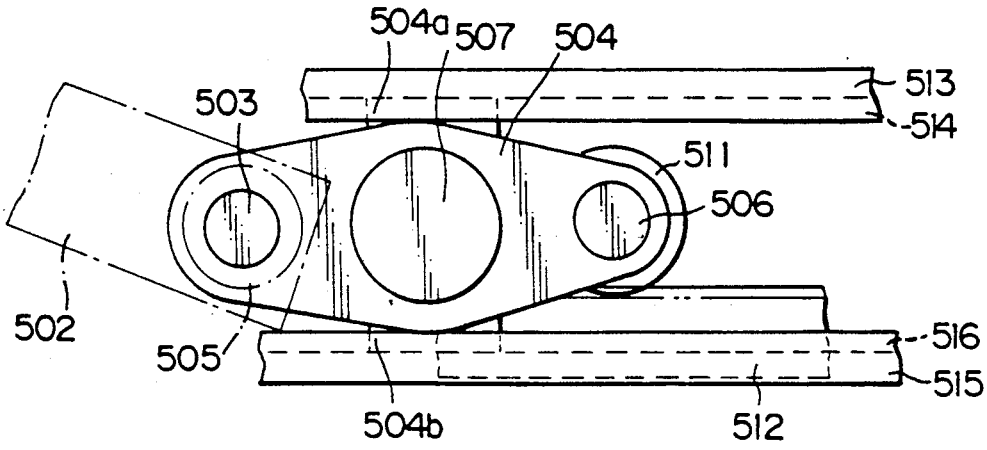

One embodiment of the cloth presser unit 500 is shown in FIGS. 13 to 15, in which a pair of levers 502 are secured at their proximal ends to a support shaft 503 which extends in the X-direction, i.e. in the width direction of the carriage, and coupled at one end to a drive motor 505 via a clutch 508.

Each lever 502 is accompanied with a short lever 502*a* which is pivoted to its distal end. The small lever 502*a* rotatably holds a press roller 501 at its distal end. Further, a cutter block 410 of the cutter unit 400 is mounted to the short lever 502*a* in the vicinity of the press roller 501 in a arrangement reciprocal in the X-direction as later described in more detail.

The press roller 501 is designed to move in the Z- and Y-directions in order to wind a cloth about an empty roll ER. One example of the driving system for the press roller 501 is shown in FIGS. 14 and 15. As stated above, the support shaft 503 is coupled to the drive motor 505 which is mounted to one end of a bracket 504. The bracket 504 extends in the Z-direction and rotatably holds a transmission shaft 506 at the other end. A Z-direction drive motor 507 is mounted to the bracket 504 at a position between both shaft 503 and 506. This drive motor 507 is coupled to the transmission shaft 506 via intermediate gears 509 and 510. A pair of guide rails 513 and 515 is mounted to the carriage frame 1 while extending in the Z-direction at levels above and below the bracket 504. As best seen in FIG. 15, a pair of guide pieces 504*a* and 504*b* project vertically from the upper and lower faces of the bracket 504 in engagement with guide grooves 514 and 516 formed in the upper and lower guide rails 513 and 515, respectively.

The transmission shaft 506 is carried by a guide block 12 of the arm drive unit 50 via a bushing (not shown) in an arrangement movable in the Z-direction. A pinion 511 is secured to the outer end of the transmission shaft 506 in meshing engagement with a rack 512 which is secured to the guide block 12 and extends in the Z-direction. The motors 505, 507 and the clutch 508 are electrically connected to the central processing unit 104 shown in FIG. 12.

As the drive motor 507 is activated, rotation of the transmission shaft 506 causes movement of the bracket 504 in the Z-direction due to the pinion-rack engagement (511, 512) along a path defined by the upper and lower guide rails 513, 514, and the press roller 501 is moved in the same direction via the lever 502 pivoted to the bracket 504. Further, the press roller 501 is driven for a swing movement in the Y-direction, i.e. the vertical direction as the drive motor 505 on the bracket 504 is activated.

Figure 16:
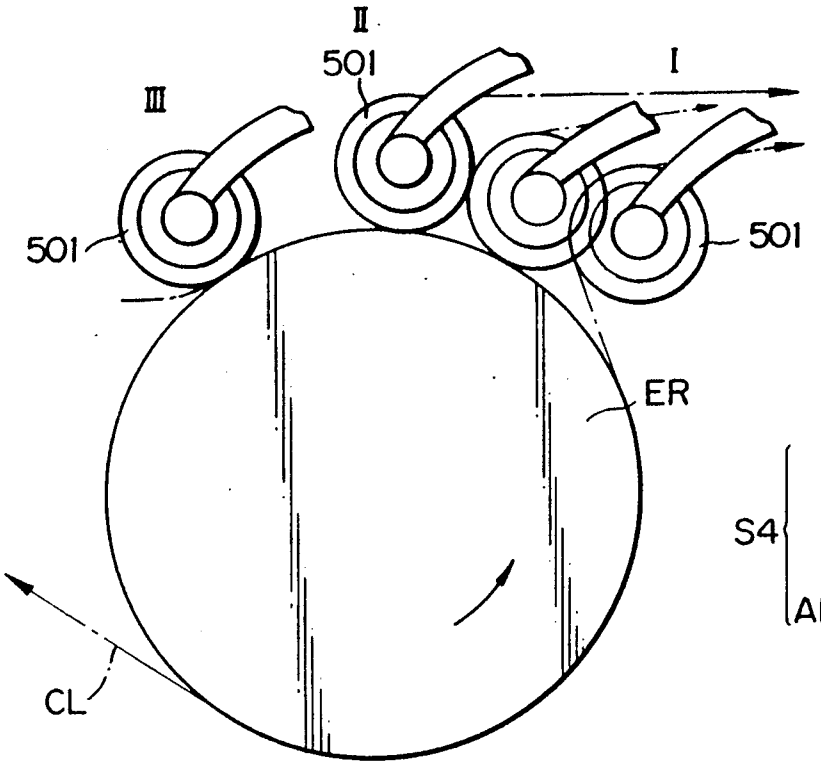
FIG. 16 is a side view for showing operation of the cloth presser unit.

Operation of the press roller 501 will now be explained in reference to FIG. 16. When the press roller 501 has moved from the stand-by position E to the locking station B in FIG. 3, a cloth CL on the loom extends from the cloth being woven to a full roll FR transferred to the auto-doffer in engagement with the lower face of an empty roll ER held by the lock unit 600 of the loom. Due to engagement with the press roller 501, the cloth CL is kept in tension at this moment. When the press roller 501 is registered at a position I in FIG. 16 above the top face of the empty roll ER, the clutch 508 is open to disconnect the roller 501 from the drive motor 505. Then the weight of the press roller 501 is applied to the top face of the empty roller ER via the cloth CL. With continued rotation of the transmission shaft 506 driven by the drive motor 507, the press roller 501 advances forwards keeping a rolling contact with the top face of the empty roller ER via the cloth CL towards a position II in FIG. 16.

Due to this travel fo the press roller 501, the cloth in tension is pressed to and wound about the empty roll ER. After transverse cutting of the cloth CL by the cutter block 410, the free end of the cloth CL connected to the cloth being woven is pressed against the face of the empty roll ER by continued forward travel of the press roller 501. Although the empty roll ER continues its rotation during this process of cloth winding, rotation of the press roller 501 and its rolling contact with the empty roll ER enable smooth winding of the free end of the cloth CL about the face of the empty roll ER. In this way, the free end of the cloth CL connected to the cloth being woven is reliably wound about the empty roll ER without any trouble.

In the case of the illustrated example, the press roller 501 continues its forward movement, even after passing the position II, to a position III and this continued forward movement further assures trouble-free winding of the free end of the cloth CL about the empty roll ER. Thereafter, the transmission shaft 506 is driven for a reverse rotation and the press roller 501 now moves rearwards. On arrival at the position I, the clutch 508 is closed to connect the drive motor 505 to the press roller 501. By subsequent activation of the drive motors 505 and 507, the cloth presser unit 500 returns to the stand-by position E shown in FIG. 3.

It is not strictly required for the press roller 501 to perform the rolling contact with the empty roll ER. What is required is for the press roller 501 is to press the cloth CL in tension against the face of the empty roll ER until the transverse cutting by the cutter block 410 of the cutter unit 400. In addition to pressing by the weight of the press roller 501 only, the clutch 508 may be closed at the moment of weight application in order to swing the lever 502 downwards for artificial pressure contact of the press roller 501 with the face of the empty roll ER.

A torque clutch may be used to this end so that the press roller 501 should be moved forwards while keeping the level at the position I. In this case, the press roller 501 constantly applies a pressure corresponding to the torque of the clutch to the face of the empty roll ER. The face of the empty roll ER may be roughened by means of spraying process or rendered clingy by use of bonding tapes, both for better capture of the free end of the cloth. As a substitute for a press roller, a press bar or other press or elements may be used.

Use of the cloth presser unit 500 of the above-described construction and operation removes the trouble of complicated design of the traveling path of the press roller since the press roller automatically travels along the face of the empty roll ER only by moving the same in the Z-direction. In addition, such a mode of travel of the press roller assures successful winding of the free end of the cloth about the empty roll.

Wind Detector Unit 550

The auto-doffer in accordance with the present invention is preferably provided with a wind detector unit 550 which is involved in detection of success in winding operation by the above-described cloth presser unit 500.

As stated above, the free end of the cloth CL connected to the cloth being woven is wound about an empty roll ER by assistance of the cloth presser unit 500 after transverse cutting of the cloth. Possible absence of good contact between the free end of the cloth and the empty roll ER often tends to cause failure in the initial winding and the free end of the cloth hangs down on the floor. When the press roller 501 is positively brought into pressure contact with the empty roll ER, the free end of the cloth CL sometimes does not enter into the gap between the press roller 501 and the empty roll ER and, as a consequence, winds around the press roller 501 too.

In the case of such defective winding, the cloth has to be treated as a condemnable product or subjected to troublesome rewinding operation.

Due to the highly automated situation in the mill, very few operators constantly supervise the weaving condition on individual looms. Once any defective winding starts on one loom, such a situation will be left for a long period without attention by the operators. As a consequence, a great deal of cloth is treated as a condemnable product or a great deal of manual labour is needed for the rewinding operation, both resulting in great loss in material, time and labour.

From this point of view, it is strongly demanded that accidental occurrence of defective winding of cloth to an empty roll should be automatically announced to operators in order to invite their early attention. The wind detector unit 550 in accordance with the present invention is intended to well meet this requirement.

Figure 17:
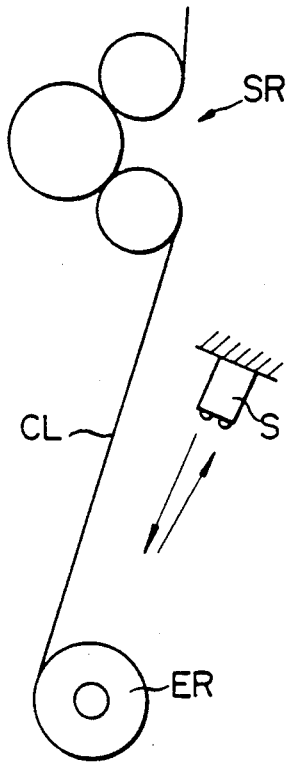
FIG. 17 is a side view of one embodiment of the wind detector unit preferably used for the auto-doffer in accordance with the present invention.

One embodiment of the wind detector unit 550 is shown in FIG. 17, in which detection is carried out with respect to the first one complete wind of the cloth CL. The cloth CL connected to the cloth being woven is guided to an empty roll ER via surface rollers SR and a non-contact type sensor S such as a photoelectric sensor is arranged to be directed to the face of the empty roll ER.

Figure 19:
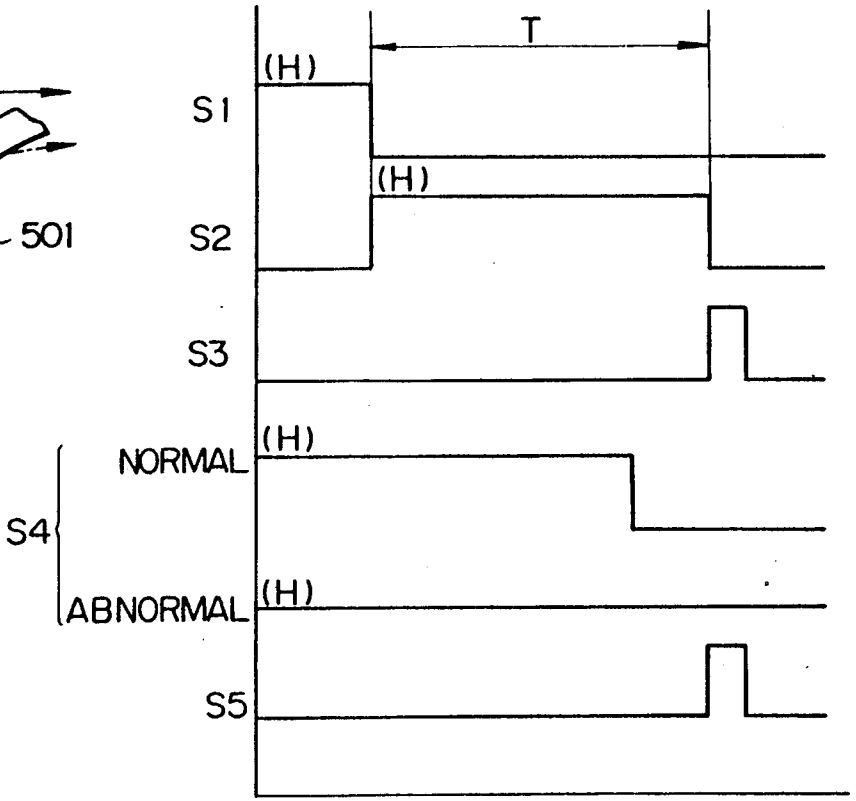
FIG. 19 is a graph for showing time functional change of signals to be processed in the circuit shown in FIG. 18.
Figure 18:
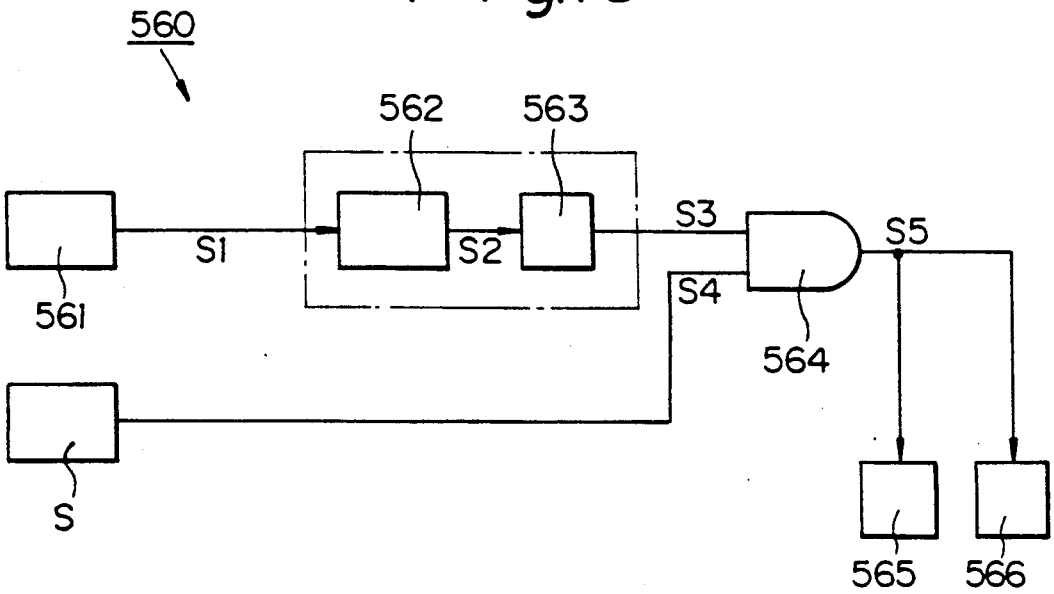
FIG. 18 is a block diagram of one example of a signal processing circuit used in combination with the sensor shown in FIG. 17.

One example of a signal processing circuit used in combination with the sensor S is shown in FIG. 18, and time functional change in signal to be processed in shown in FIG. 19. As the cloth presser unit 500 moves rearwards after winding of the cloth CL, the movement is sensed by a limit switch 561 provided on the carriage frame 1 and a signal S1 indicating start of winding is generated. As an alternative to such a limit switch 561, a like signal may be generated by the central processing unit 104 shown in FIG. 12 at a moment appointed by a given program. On receipt of the signal S1, a timer 562 issues a signal S2 over a period T necessary for one complete wind of the cloth CL to the empty roll ER. In practice, however, the life of the signal S2 is designed a little longer than the above-described period T. On receipt of the signal S2, a one-shot multi-vibrator 563 passes a signal S2 to one input terminal of an AND-gate 564 at the end of the period T. The other input terminal of the AND-gate 564 is connected to the sensor S shown in FIG. 17. The output terminal of the AND-gate 564 is connected to a proper alarm 565, and further to a control circuit 566 of the loom when necessary.

In the case of normal cloth winding, a detection signal S4 from the sensor S is kept at H-level in accordance with a beam reflected by the face of the empty roll ER and, about the end of the period T, shifted to L-level in accordance with a beam reflected by the cloth CL wound about the empty roll ER. So, the alert signal S5 issued by the AND-gate 564 is at L-level and the alarm 565 is not activated.

In the case of abnormal, defective cloth winding, the detection signal S4 is kept at the H-level even at the end of the period T. So, the alert signal S5 issued by the And-gate 564 is shifted to H-level and the alarm 565 generates a visible and/or audible alert to announce occurrence of the defective cloth winding to operators. When the control circuit 566 is connected to, running of the loom is concurrently stopped too.

Figure 21:
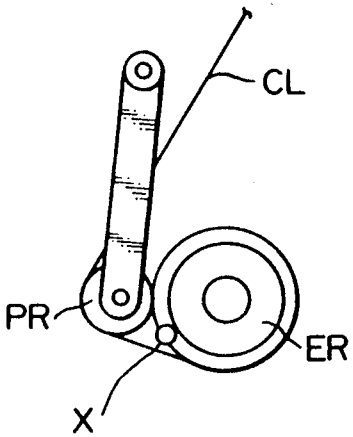
FIG. 21 is a side view for showing the preferable zone of detection by the wind detector unit shown in FIG. 20.
Figure 20:
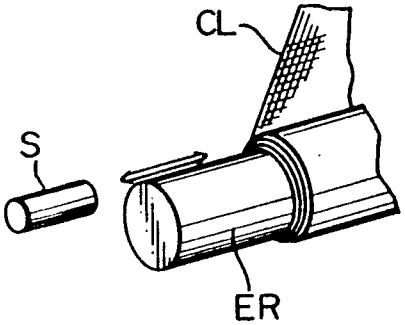
FIG. 20 is a perspective view of another embodiment of the wind detector unit.
Figure 23:
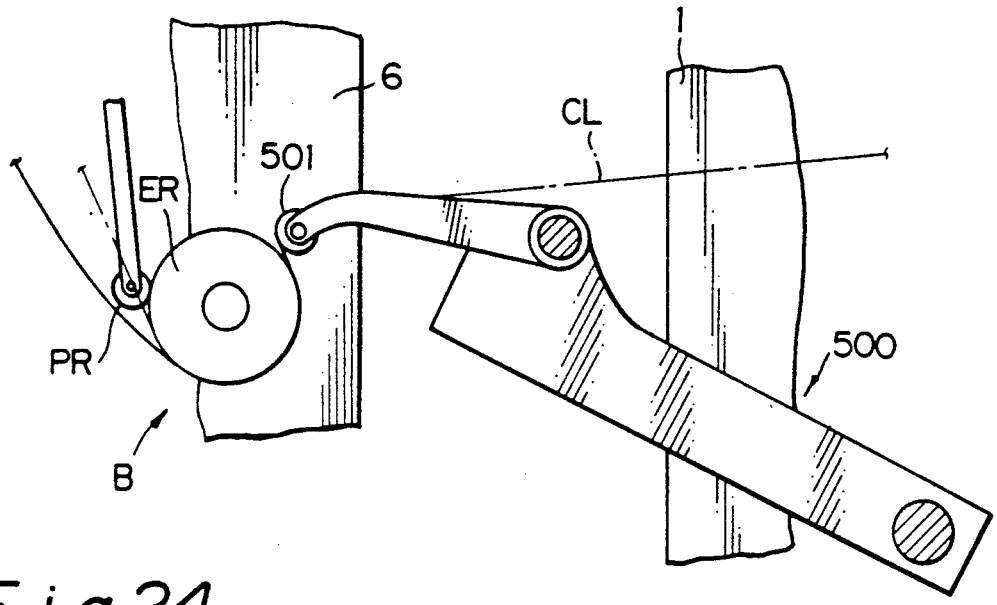
FIG. 23 is a side view of an empty roll at the moment of cloth cutting.

Another embodiment of the wind detector unit 550 is shown in FIG. 20, in which detection is carried out with respect to prescribed number of winds of the cloth CL. In this case, a non-contact type sensor S is directed to one selvage of a cloth CL wound about the empty roll ER. When the prescribed number of winds are present on the empty roll ER, the cloth CL is positioned in the course of a beam issued by the sensor S which thereupon issues a detection signal S4 at the L-level. In connection with this system, the sensor S is preferably directed to a zone X shown in FIG. 21 which is located near the first contact of the cloth CL with the empty roll ER. With this arrangement, the wind detector unit 550 is able to detect winding of the cloth CL about the cloth press roller PR too. This sensor S can be used in combination with the signal processing circuit 560 shown in FIG. 18 too. The period T in this case should be equal to, or preferably a little longer than, the time necessary for the prescribed number of winds of the cloth CL to the empty roll ER.

Figure 22:
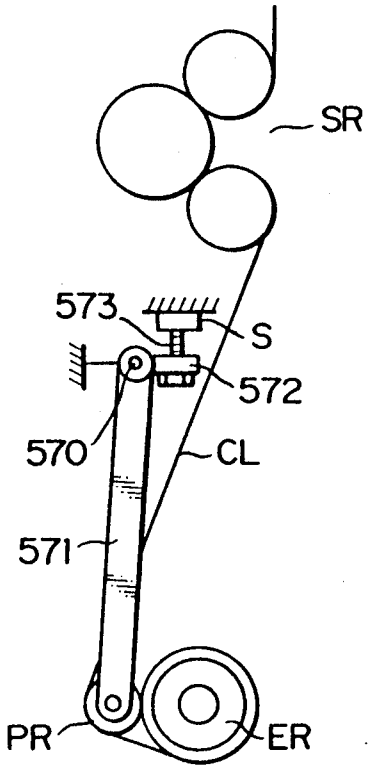
FIG. 22 is a side view of the other embodiment of the wind detector unit utilizing a contact type sensor.

A variant of the second embodiment of the wind detector unit 550 is shown in FIG. 22 in which a contact type sensor is used for detection of cloth winding. In the case of the illustrated example, the cloth press roller PR is utilized to this end. This press roller PR is rotatably coupled to the lower end of a lever 571 pivoted at 570 to the frame of the loom. This lever 571 is provided with a monolithic branch arm 572 extending in a direction substantially normal to the lever 571. A pin 23 is fixed to the branch arm 572 in contact with a sensor S secured to the frame of the loom. As the prescribed number of winds of the cloth CL are present on the empty roll ER, the press roller PR is pushed away from the center of the empty roll ER and this condition is detected by the sensor S via the pin 573 on the branch arm 572.

Cloth winding can also be detected depending on a mechanism quite different from those employed in the foregoing embodiments. In a driving system for an empty roll, rotation of a drive shaft is generally transmitted to an empty roll shaft, i.e. a driven shaft, via a friction clutch. When no cloth is wound about the empty roll under rotation, there is no load to be generated by cloth winding and there is no slip in rotation of the friction clutch. As a consequence, there is no gap in rotation between the drive and driven shafts. When the cloth starts to be wound about the empty roll, there appears a load generated by cloth winding. A slip appears in the rotation of the friction clutch and, as a consequence, rotation of the driven shaft becomes slower then that of the drive shaft. That is, a gap in rotation appears between the drive and driven shafts. This gap can be utilized for detection of cloth winding.

More specifically, rotation sensors are arranged for the drive and driven shafts, respectively. When gap in rotation is not detected via the rotation sensors within a prescribed period after the initial winding, presence of a defective winding is confirmed.

Thanks to the above-described automatic detection of a defective winding by the wind detector unit 550, loss in material, time and labour in cloth production can be reduced significantly.

Cutter Unit 400

The cutter unit 400 cooperates with the above-described cloth presser unit 500 and is involved mainly in the operational step (Xi). After a full roll FR has been transferred to the carriage and an empty roll ER has been transferred to the loom, a cloth CL connected to the cloth being woven extends from the surface roller of the loom to the full roll FR placed at the full roll station C in FIG. 3, past the underside of the empty roll ER and the upper side of the press roller 501 of the cloth presser unit 500 at the locking station B in FIG. 3. Before the initial winding of the cloth CL to the empty roll ER, the cloth CL has to be cut transversely at a position between the empty and full rolls ER, FR. For successful cutting, the cloth CL needs to be kept in tension. However, tension in excess would deliver the cloth CL from the full roll FR. To avoid this trouble, tension to be applied to the cloth CL must be adjusted to a necessary but minimum level.

One embodiment of the cutter unit 400 in accordance with the present invention is shown in FIGS. 23 to 26. Under the condition shown in FIG. 23, the cloth presser unit 500 has moved forwards and upwards from the stand-by position E in FIG. 3 and its press roller 501 is in contact with the empty roll ER at the locking station B on the loom. The cloth CL runs from the surface roller (not shown) to the full roll FR (not shown) past the underside of the press roller PR of the loom and the empty roll and the upper side of the press roller 501 of the cloth presser unit 500. The cloth CL must be cut at a position between the empty and full rolls ER, FR.

Figure 24:
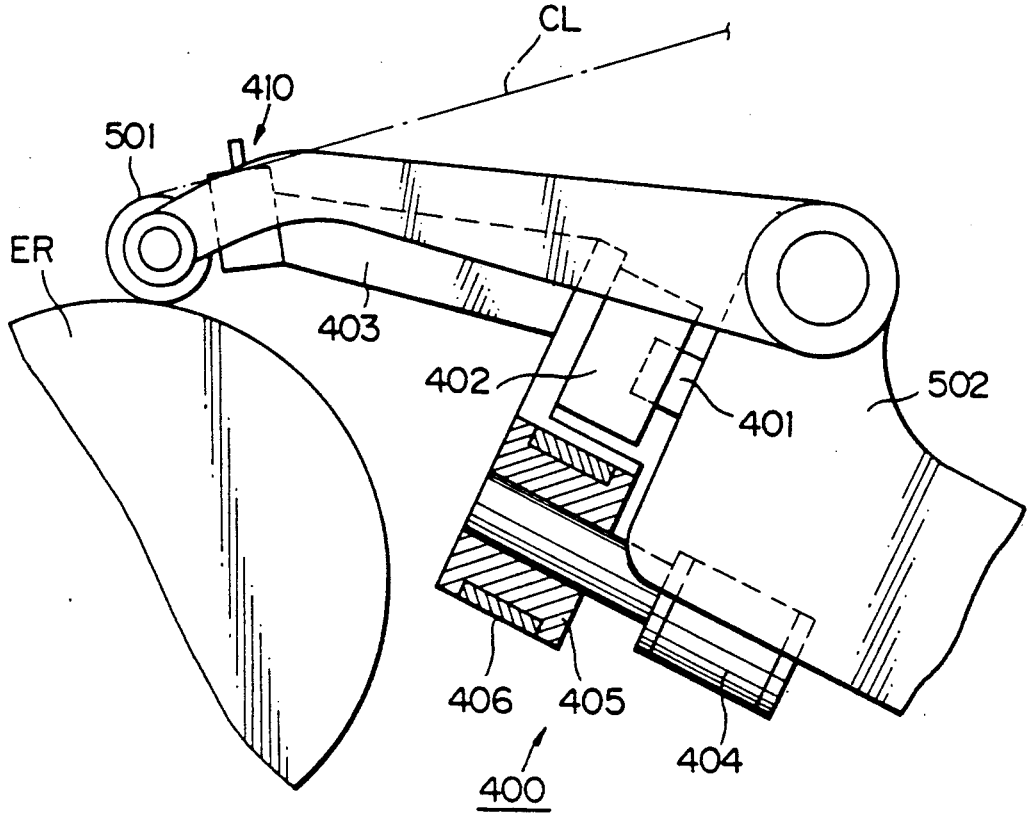
FIG. 24 is a side view, partly in section, of one embodiment of the cutter unit in accordance with the present invention.

In the arrangement shown in FIG. 24, a guide rail 401 is secured to the distal end of the lever 502 of the cloth presser unit 500 while extending in the X-direction, i.e. the width direction of the carriage. A slider 402 slidably riding on the guide rail 501 holds a lever 403 projecting in the Z-direction. A cutter block 410 is mounted to the distal end of the lever 43 in order to transversely cut the cloth CL at the illustrated position. A drive motor 404 is mounted to the lever 502 near its distal end and its output shaft projecting in the Z-direction securely carries a pulley 405. Though not illustrated in the drawing, a like pulley is mounted for rotation to the other like lever of the cloth presser unit 500 being horizontally spaced from the illustrated pulley 405 in the X-direction. The drive motor 404 is electrically connected to the central processing unit 104 shown in FIG. 12. An endless belt 406 runs on the pulleys 405 in tension and the above-described slider 402 is coupled to this belt 406. As the drive motor 404 is activated, the slider circulates in the X-direction with the cutter block 410 so that a cutter 414 mounted to the cutter block 410 should transversely cut the cloth CL held in tension.

Figure 25:
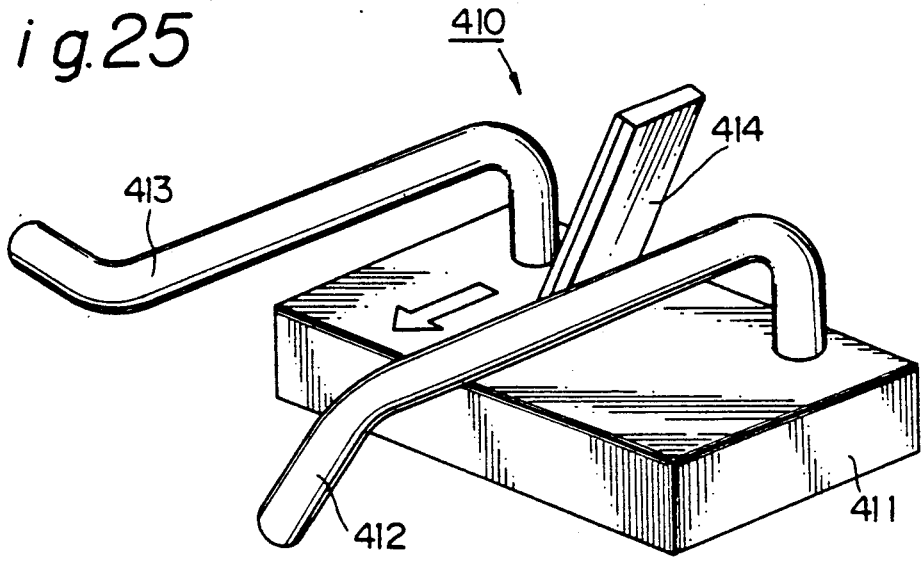
FIG. 25 is a perspective view of one example of the cutter block used for the cutter unit.

One example of the cutter block 410 is shown in FIG. 25, in which the cutter block 410 includes a substantially flat base 411. A pair of tension bars 412 and 413 are secured to the top face of the base 411 in parallel to each other and extend in the X-direction, i.e. the circulating direction of the cutter block 410. The distal end of one tension bar 412 is curved downwards whereas the distal end of the other tension bar 413 is curved upwards. Such curvature is preferably employed for smooth engagement with the selvage of the cloth CL at initiation of the cutting operation and directions of the curvature may be reversed. At a position between the tension bars 512 and 513 is arranged a the cutter 414 in a somewhat inclined disposition with its blade being directed in the X-direction. Preferably, the angle of inclination of the cutter 414 is adjustable depending on the process conditions. As stated above, the cutter block 410 circulates in the direction of the illustrated arrow.

Figure 26:
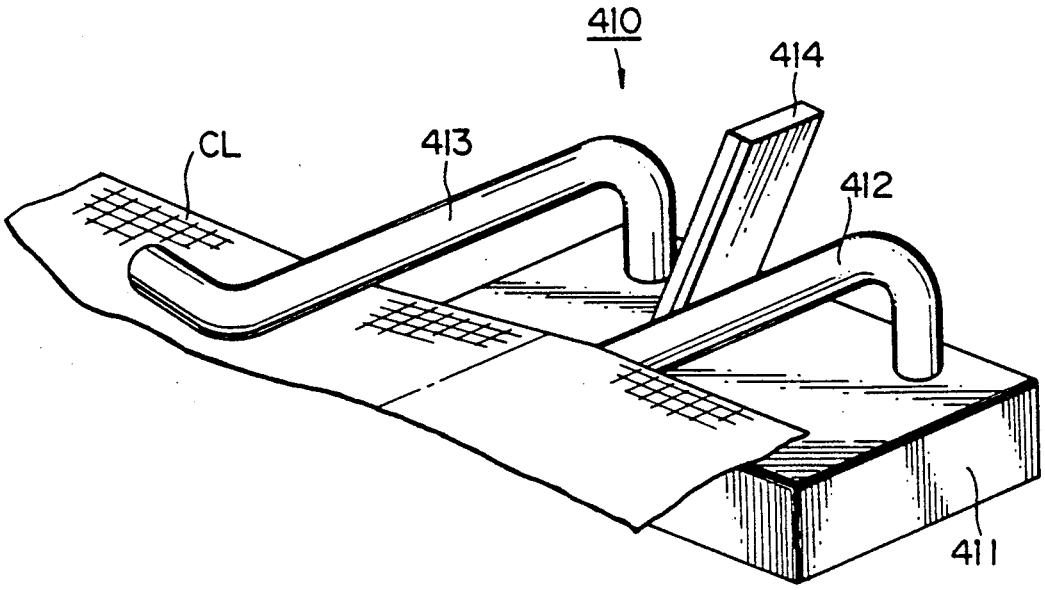
FIG. 26 is a perspective view of the cutter block shown in FIG. 25 in operation.

At the initiation of cutting, the cutter unit 400 assumes a position shown in FIG. 26. Due to engagement with the tension bars 412 and 413, the cloth CL is a little curved between the tension bars 412 and 413, thereby kept in tension. Under this condition, the cutter block 410 starts to move in the direction of the arrow illustrated in FIG. 25, the cutter 414 cuts the cloth CL along a two-dot chain line in the drawing. In the case of the illustrated example, the cloth CL runs in contact with the lower face of the second tension bar 413 and the upper face of the first tension bar 412. Depending on the type of the end curvature of the tension bars, the mode of contact may be reversed. Degree of tension to be imparted to the cloth CL can be adjusted freely by arranging the tension bars 412 and 413 at different levels from the top face of the base 411.

Figure 27:
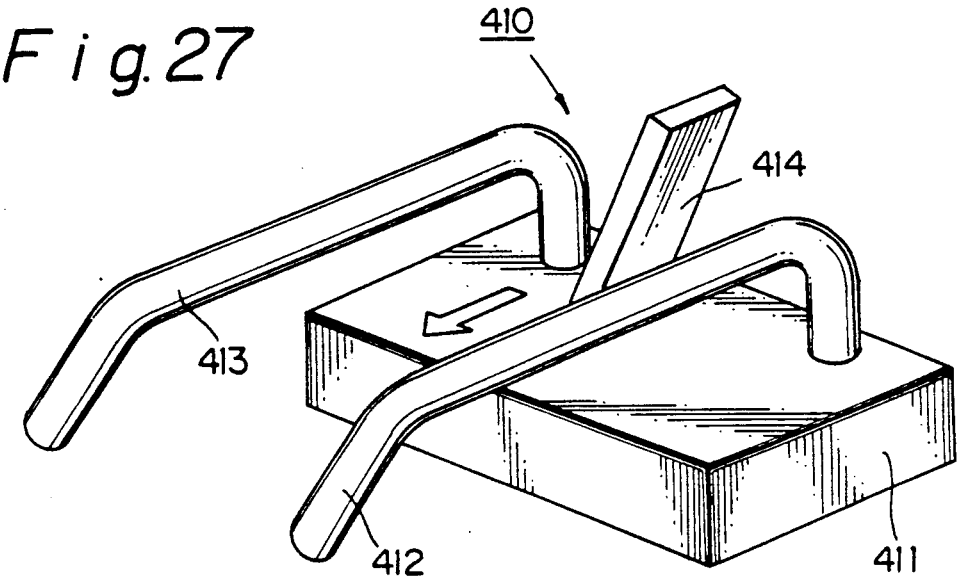
FIG. 27 is a perspective view of another example of the cutter block used for the cutter unit.

Another example of the cutter block 410 is shown in FIG. 27, in which the distal ends of the tension bars 412 and 413 are curved in a downward direction. As the cutter block 410 moves forwards, the cloth CL in contact with the tension bars 412 and 413 is somewhat warped upwards so that a greater tension should be imparted to the cloth CL. There is no limiting member above the cloth CL in the case of this example. So, even when the cloth CL would jam in front of the cutter 414 because of its blunt cutting, the cloth CL can move freely along the inclined blade of the cutter 414 and is automatically cut during this slope movement.

The same effect can also be obtained in the case of the arrangement shown in FIG. 25, if the proximal end of the second tension bar 413 is curved upwards. With this construction, the degree of upper limit by the second tension bar 413 is reduced so that the cloth CL could climb the inclined blade of the cutter 414 in a tensioned state.

By use of the above-described cutter unit 400, the cloth CL can be cut transversely with necessary but minimum local tension in the region of cutting only without any ill influence on other sections of the cloth CL.

Cut Detector Unit 450

The cutter unit 400 in accordance with the present invention is preferably accompanied with a cut detector unit 450 which detects the result of the cutting operation by the cutter unit 400. When operational steps subsequent to cutting are carried out despite occurrence of defective cutting, serious accident may happen to disable further continuation of weaving on the loom. In addition, occurrence of such defective cutting cannot be found by mill operators without delay just in the case of the above-described deffective cloth winding by the cloth pressor unit 500.

Figure 28:
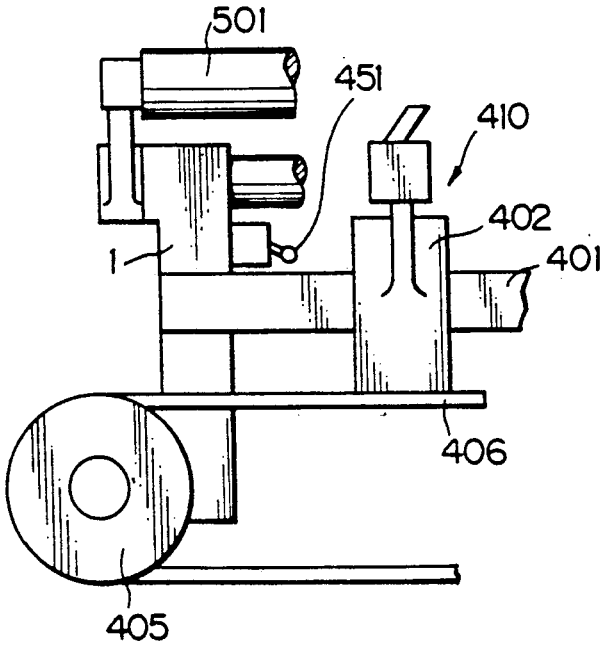
FIG. 28 is a front view of one embodiment of the cut detector unit preferably used for the auto-doffer in accordance with the present invention.
Figure 29:
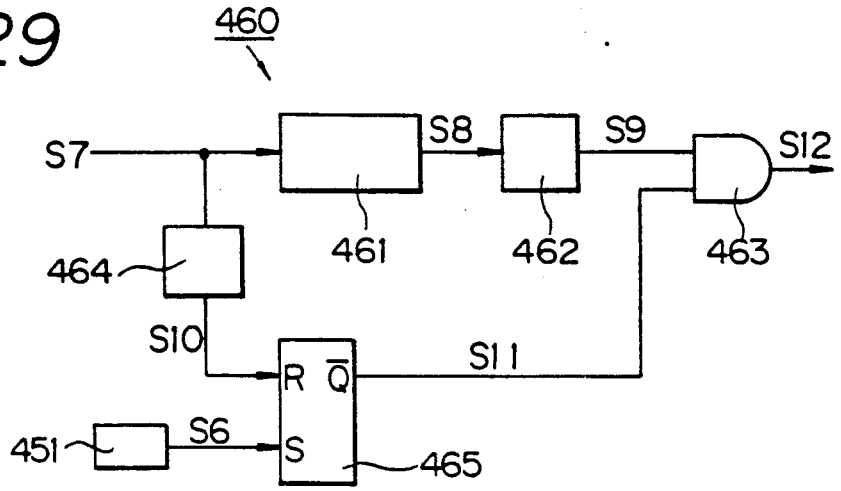
FIG. 29 is a block diagram of one example of the signal processing circuit used for the cut detector unit shown in FIG. 28.

One embodiment of such a cut detector unit 450 is shown in FIGS. 28 and 29. In the arrangement shown in FIG. 28, a limit switch 451 is mounted to the carriage frame 1 facing the guide rail 401 of the cutter unit 400 on the arrival side of the cutter block 410 so as to issue a detection signal S6 on arrival of the slider 402.

Figure 30:
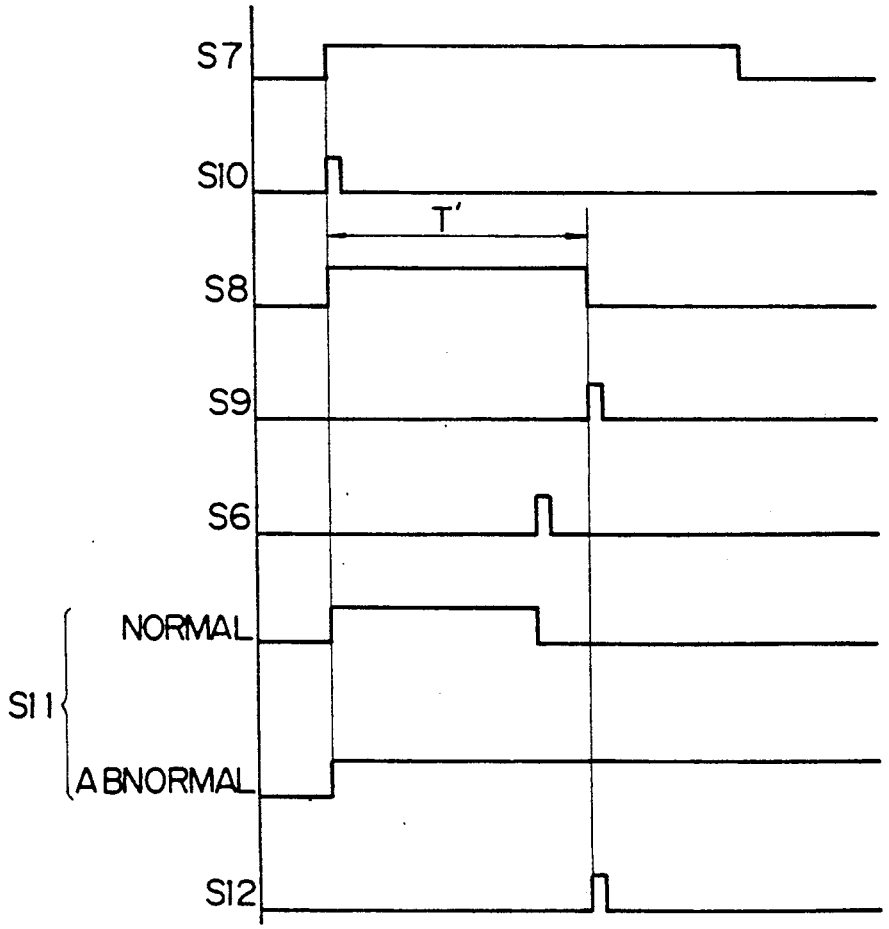
FIG. 30 is a graph for showing time functional change of signals to be processed in the circuit shown in FIG. 29.

A signal processing circuit 460 for the limit switch 451 is shown in FIG. 29 and its operation will now be explained in reference to FIG. 30. A command signal S7 generated at activation of the cutter unit 400 or arrival of the press roller 501 of the cloth presser unit 500 at its most forward position shown in FIG. 16 is passed on one hand to a timer 461 and, on the other hand, to a one-shot multivibrator 464. The prescribed period T' set by this timer 561 is equal to the length of time needed for arrival of the slider 402 from the moment of its start. In practice, however, this period T' is designed a little longer than the length of the time. With a delay equal to the period T', a signal S9 at H-level is passed to one input terminal of an AND-gate 463 by a on-shot multivibrator 462. One receipt of the command signal S7, the one-shot multivibrator 464 generates a signal S10 which is passed to the R-terminal of a flip-flop 465. The detection signal S6 from the limit switch 451 is passed to the S-terminal of the flip-flop 465. This detection signal S7 assumes H-level in the case of normal cutting in which the slider 402 arrives at the position of the limit switch 451 within the period T' set by the timer 461.

When cloth cutting is carried out normally, an output signal S11 from the flip-flop 465 assumes L-level and is passed to the other input terminal of the AND-gate 463. As a consequence, the AND-gate 463 issues a signal at L-level. That is, the cut detector unit 450 does not issue an alert signal S12. When cloth cutting is carried out abnormally, the output signal S11 from the flip-flop 465 remains at H-level even at the end of the period T' set by the timer 461. As a consequence, the AND-gate 463 issues a signal at H-level. That is, the cut detector unit 450 issues the alert signal S12.

In the case of the above-described construction, the one-shot multivibrator 464, the limit switch 451 and the flip-flop 465 form detecting means; the timer 461 and the one-shot multivibrator 462 form prescribed period setting means; and the AND-gate forms compassing means.

Figure 31:
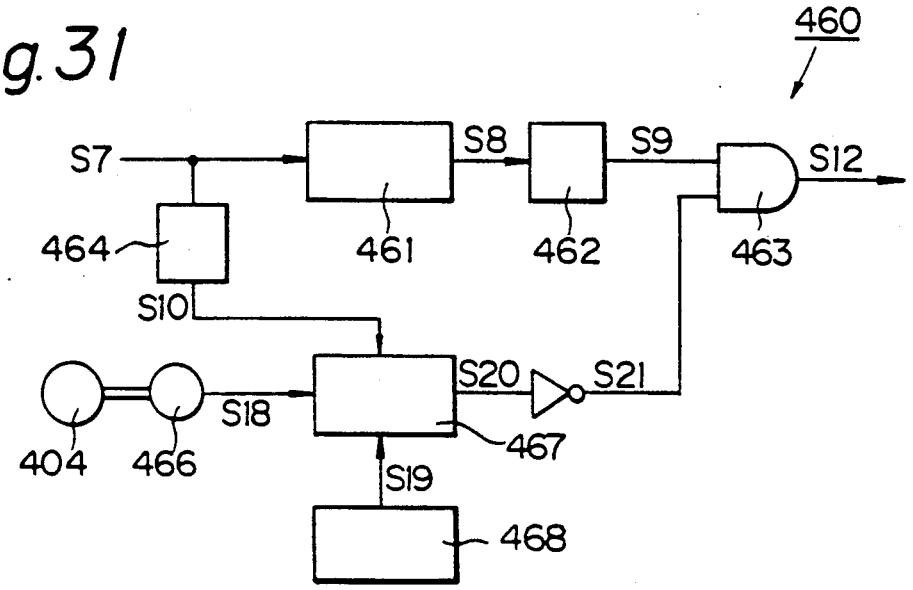
FIG. 31 is a block diagram of another example of the signal processing circuit used for the cut detector unit.
Figure 32:
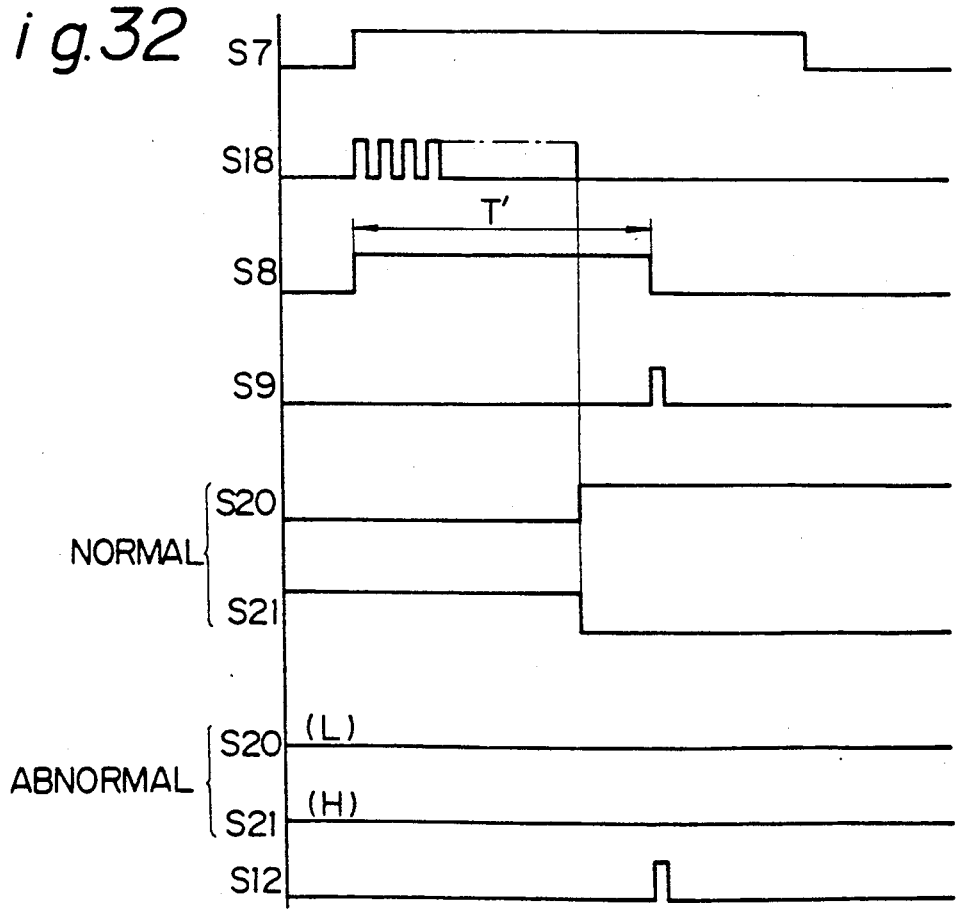
FIG. 32 is a graph for showing time functional change of signals to be processed in the circuit shown in FIG. 31.

Another example of the signal processing circuit 460 is shown in FIG. 31 and the mode of its signal processing is shown in FIG. 32. Like the foregoing example, this circuit 460 includes a timer 461 for setting the prescribed period T', one-shot multivibrators 462 and 464 and an AND-gate 463 generative of an alert signal S12. As a substitute for the flip-flop 465 used in the foregoing example, a counter 467 is interposed between the one-shot multivibrator 464 and the AND-gate 463 so that the signal S10 should be passed to the reset terminal of the counter 467. This counter 467 is of a down-count type. A setter 468 is connected to the counter 467 and generates a signal 19. This signal S19 is indicative of a value which is somewhat smaller than the total rotation amount of the drive motor 404 needed for arrival of the cutter block 410. The drive motor 404 is accompanied with an encoder 466 for measurement of the accumulated rotation amount of the drive motor 404 and generation of a corresponding signal S18. The above-described accumulated rotation amount of the drive motor 404 represents the amount of displacement of the cutter block 410, i.e. the cutter 414. When the value of the signal S18 from the encoder 466 is larger than the value of the signal S19 given by the setter 468 within the prescribed period T', cutting is regarded as being carried out normally. Otherwise the cutting is regarded as being carried out abnormally and the alert signal S12 is generated by the AND-gate 463.

In the case of the above-described construction, the one-shot multivibrator 464, the encoder 466, the counter 467, the setter 468 and an inverter form detecting means; the timer 461 and the one-shot multivibrator 462 form prescribed period setting means; and the AND-gate forms comparing means.

In the case of the example shown in FIGS. 31 and 32, the rotation amount of the drive motor 404 is used as an index representative of the amount of displacement of the cutter 414. A linear scale can be used as a substitute. For example, several magnets are arranged on the guide rail 401 in FIG. 28 at equal intervals and a magnetic sensor is mounted to the slider 402 in an arrangement detectable presence of the magnets. As the slider 402 moves along the guide rail 401, the number of the magnets passed by the slider 402 is counted via the magnetic sensor. As an alternative, an electric detecting system of this sense may be employed too. Light emanating elements may also be arranged on the guide rail 401 in combination with a photoelectric sensor mounted to the slider 402.

Figure 33:
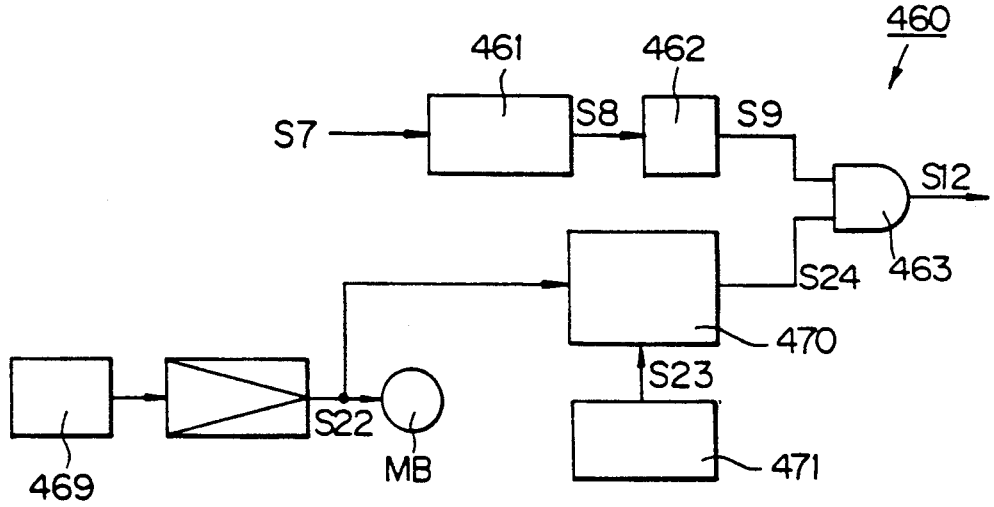
FIG. 33 is a block diagram of another example of signal processing circuit used for the cut detector unit.

Another example of the signal processing circuit 460 is shown in FIG. 33. Like the first example, the circuit 460 includes a timer 461 for setting the prescribed period T', a one-shot multivibrator 462 and an AND-gate 463 generative of an alert signal S12. For rotation of a full roll FR on the loom, a certain amount of load is imposed on its drive motor in order to stretch the cloth connected to the cloth being woven. The amount of this load decreases when the cloth is normally cut. Reduction in this load within a prescribed period can be used for detection of cloth cutting. In other words, the amount of electric current supplied to the drive motor may be detected.

In FIG. 33, the amount of current to the full roll drive motor MB is kept to a constant value by a controller 469 connected to the drive motor MB via a proper amplifier. This controller 469 is connected to a comparator 470 which receives a signal 23 from a setter 471. This signal S23 corresponds to the above-described constant value of the current to the drive motor MB. When the value of the signal S22 becomes smaller than the value of the signal S13, no alert signal is generated. Otherwise an alert signal S12 is generated by the AND-gate 463.

In the case of the above-described construction, the comparator 470 and the setter 471 form detecting means; the timer 461 and the one-shot multivibrator 462 form prescribed period setting means; and the AND-gate 463 forms comparing means.

Instead of detecting the amount of the current to be supplied to the full roll drive motor, the amount of torque loaded on the drive motor may be directly detected too.

Further, instead of the full roll drive motor MB, detection may be directed to the load on the press roller 501 of the cloth pressor unit 500. For cloth winding, the press roller 501 must be kept in pressure contact with the cloth CL by operation of the drive motor 507 via the lever 502 as shown in FIGS. 13 and 14. So, detection may be focused upon the amount of current supplied to the drive motor 507 or the amount of torque loaded on the press roller 501.

Figure 34:
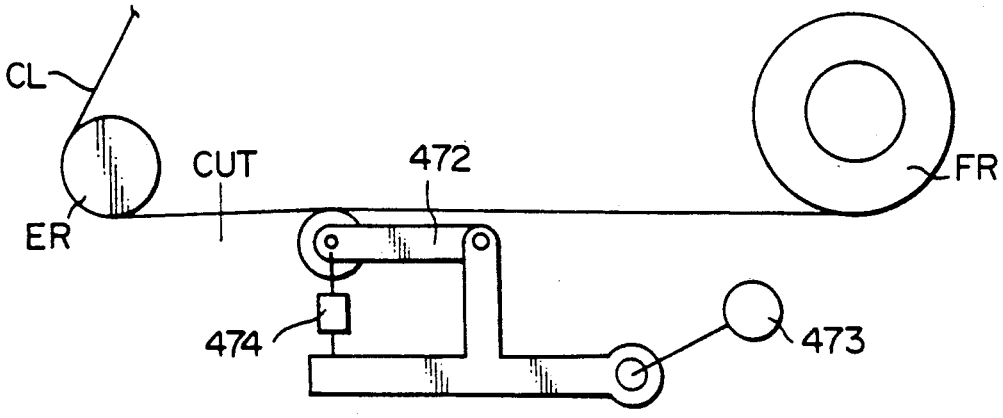
FIG. 34 is a side view of another embodiment of the cut detector unit preferably used for the auto-doffer in accordance with the present invention.
Figure 35:
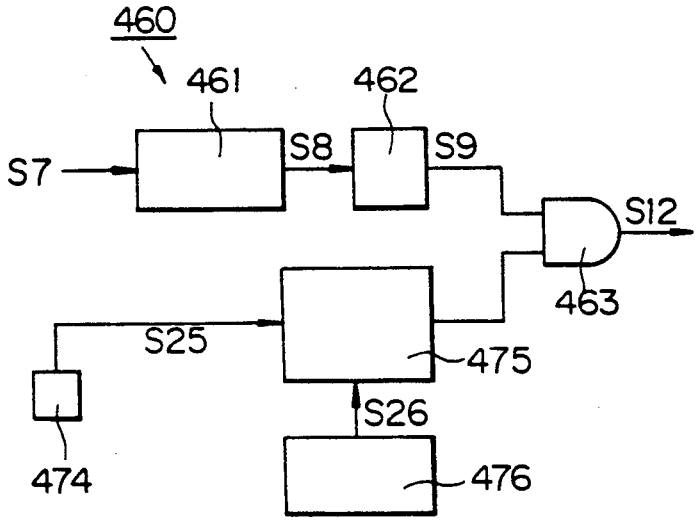
FIG. 35 is a block diagram of one example of the signal processing circuit used for the cut detector unit shown in FIG. 34.

Another embodiment of the cut detector unit 450 of this concept is shown in FIGS. 34 and 35. In FIG. 34, a cloth CL extending between an empty roll ER and a full roll FR is cut at a cut position CUT by the cutter unit 400. At a position between the cut position CUT and the full roll FR is arranged a swingable lever 472 which rotatably carries a roller in pressure contact with the cloth CL. A drive motor 473 is mechanically coupled to the lever 427 to keep such a pressure contact. Load imposed on the roller is detected by a pressure sensor 474.

A corresponding signal processing circuit is shown in FIG. 35 in which a timer 461 receptive of a command signal S7 is connected to one input terminal of an AND-gate 463 via a one-shot multivibrator 462. The pressure sensor 474 is connected to the other input terminal of the AND-gate 463 via a comparator 475 accompanied with a setter 476. The pressure sensor 474 issues a signal S25 corresponding to the load imposed on the roller carried by the lever 472, which is passed to the comparator 475. The setter 476 issues a signal S16 which correspond to a value a little larger than the pressure on the roller at the moment of cloth cutting. When the value of the signal S25 is maintained larger than the value of the signal S35 even after passage of the prescribed period T' shown in FIG. 30, an alert signal S12 is generated by the AND-gate 463.

In the case of this construction, the pressure sensor 474 and the comparator 475 form detecting means; the timer 461 and the one-shot multivibrator 462 form prescribed period setting means; and the AND-gate form comparing means.

Figure 36:
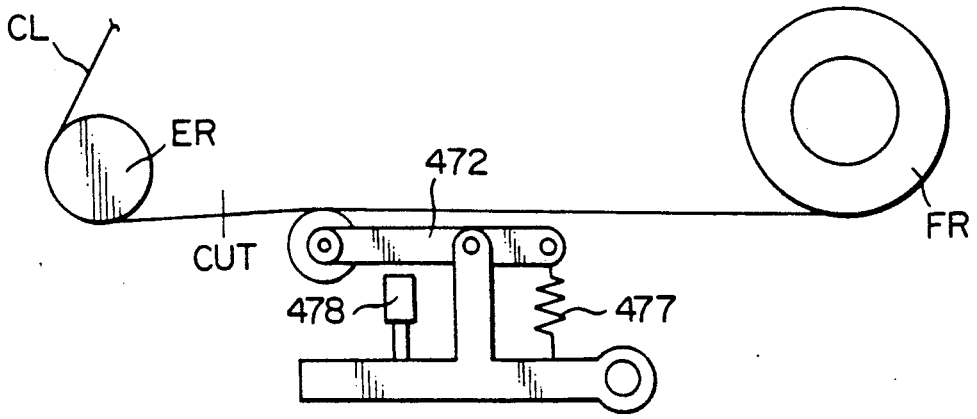
FIG. 36 is a side view of the other embodiment of the cut detector unit.
Figure 37:
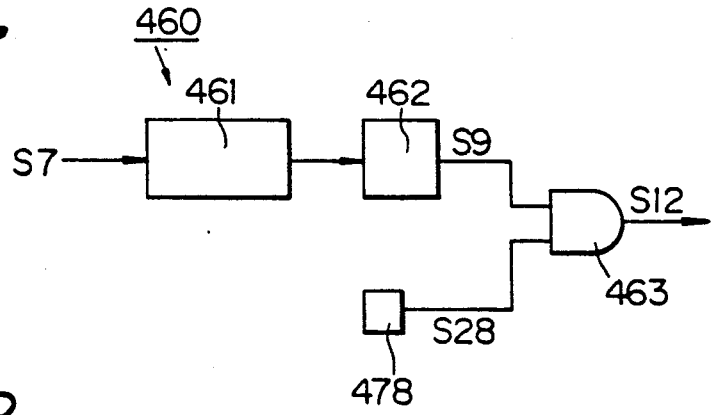
FIG. 37 is a block diagram of one example of the signal processing circuit used for the cut detector unit shown in FIG. 36.

A variant of the foregoing embodiment is shown in FIGS. 36 and 37, in which not the load on the roll but a displacement (position) of the roll held by the lever 472 is detected. In the case of this embodiment, the roll is urged to the pressure contact with the cloth CL by a tension spring 477 and a position sensor 478 such as a proximity switch is arranged facing the lower face of the lever 472.

An example of the corresponding signal processing circuit 460 is shown in FIG. 37 in which, like the foregoing examples, a command signal S7 is passed to one input terminal of an AND-gate 463 via a timer 461 and a one-shot multivibrator 462 and the position sensor 478 is connected to the other input terminal of the AND-gate 463. When the cloth CL is cut normally within the prescribed period T' (FIG. 30) and the lever swings upwards, the position sensor 478 issues no output signal. Otherwise, a detection signal S28 at H-level is issued by the position sensor 478 and the AND-gate 463 generates an alert signal S12 at H-level.

Figure 38:
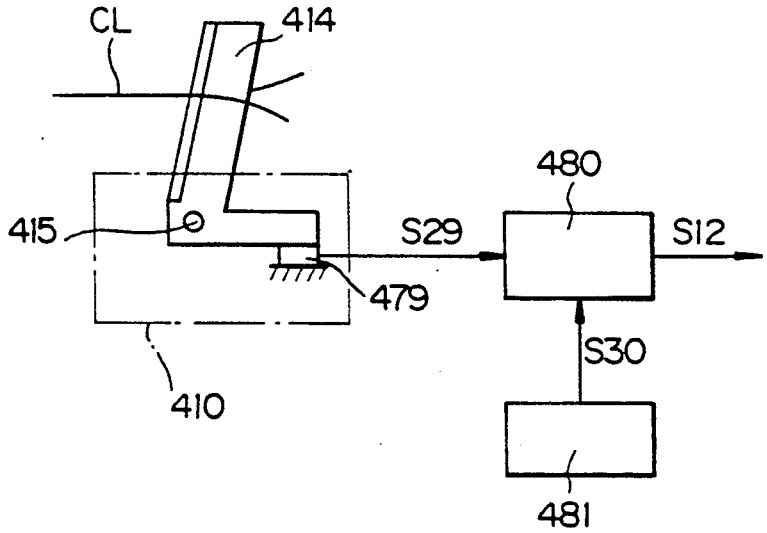
FIG. 38 is a schematic view of a further embodiment of the cut detector unit.

The other embodiment of the cut detector unit 450 in accordance with the present invention is shown in FIG. 38, in which detection is directed to a force imposed on the cutter 414 of the cutter unit 400. In the shown arrangement, the cutter 414 is mounted to the cutter block 410 at a pivot 415 and its lower branch is in contact with a sensor 479 fixed to the top face of the cutter block 410. This sensor 479 is electrically connected to a comparator 480 accompanied with a setter 481. A reference signal S30 issued by the setter 481 corresponds to a value of the force acting on the cutter 414 during normal cutting. When the value of the detection signal S29 from the sensor 479 exceed the value of the signal S30 issued by the setter 481, the comparator 480 generates an alert signal S12.

Figure 39:
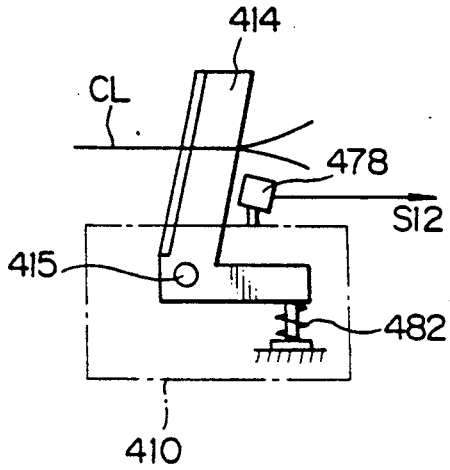
FIG. 39 is a schematic view of one variant of the cut detector unit shown in FIG. 38.

A variant of the foregoing embodiment is shown in FIG. 39 in which, like the foregoing embodiment, the cutter 414 is mounted to the cutter block 410 at the pivot 415 and a compression spring 482 is interposed between the lower branch of the cutter 414 and the cutter block 410. A position sensor 478 is arranged facing the cutter 414 on the side opposite to its advancing direction. In the case of abnormal cutting, irregularly increased force acts on the cutter 414 and a corresponding change in position of the cutter 414 is detector by the position sensor 478 which thereupon generates and alert signal S12.

Figure 40:
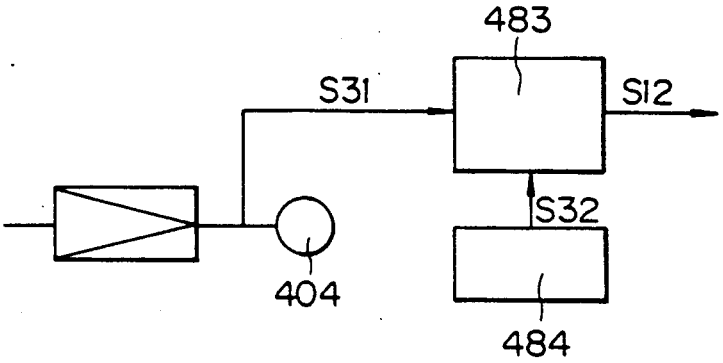
FIG. 40 is a block diagram of a further embodiment of the cut detector unit based on sensing an electrical parameter.

FIG. 40 shows another embodiment of the cut detector unit based on sensing an electrical parameter. A signal S31 corresponding to the electric current supplied to the drive motor 404 of the cutter unit 400 is passed to a comparator 483 accompanied with a setter 484. This setter 484 generates a reference signal S32 which is a little larger than the amount of current supplied to the drive motor 404 in the case of normal cutting. When the detection signal S31 exceeds the reference signal S32 during cloth cutting, the comparator 483 generates an alert signal S12.

Figure 41:
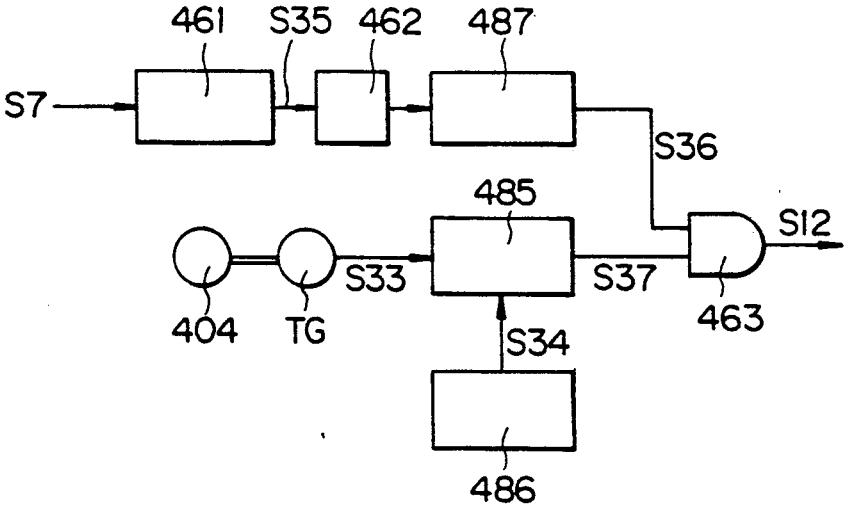
FIG. 41 is a block diagram of a further embodiment of the cut detector unit based on sensing an electrical parameter.
Figure 42:
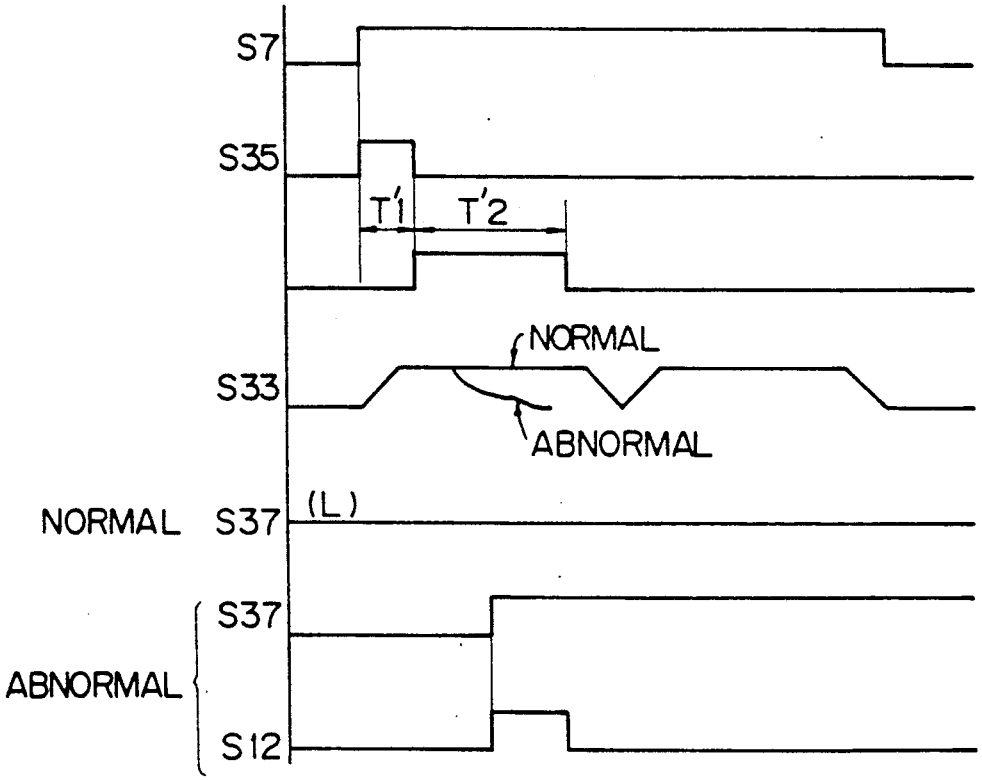
FIG. 42 is a graph for showing time functional change of signals processed in the circuit shown in FIG. 41.

A further embodiment based on sensing an electrical parameter is shown is FIGS. 41 and 42. The amount of rotation of the drive motor 404 of the cutter unit 400 is detected by a tacho-generator TG which thereupon passes a corresponding detection signal S33 to a comparator 485. This comparator 485 is accompanied with a setter 486 which generates a reference signal S34 corresponding to the moving speed of the cutter 414 in the case of normal cutting. A command signal S7 is supplied to a timer 461 which sets a prescribed period T'1. An output signal S35 of the timer 461 is passed to another timer 487 via a one-shot multivibrator 462. The timer 487 sets another prescribed period T'2. The second timer 487 passes a signal S36 to one input terminal of an AND-gate 463 and the comparator 485 passes a signal S37 to the other input terminal of the AND-gate 463.

The detection signal S33 from the tacho-generator TG is examined at the comparator 485 over a period from the initial input of the command signal S7 to the end of the second prescribed period T'2. When the detection signal S33 falls short of the reference signal S34, the AND-gate 463 generates an alert signal S12.

A timer for counting a unit period may be added to the circuit shown in FIG. 41 as a substitute for the tacho-generator TG attached to the drive motor 404 of the cutter unit 400. The number of pulse signals issued by an encoder per the unit period may be checked. The position of the cutter 404 can also be checked by the rotation amount of the drive motor or by a linear scale attached to the guide rail 401. It is also employable to detect the deceleration speed of the cutter 404. In the case of normal cutting, the cutter 404 moves at a constant speed with no deceleration. When any trouble starts in cutting, the movement of the cutter 404 is decelerated and this deceleration speed can be utilized for detection of the cutting operation.

Full Roll Drive Unit 300

The auto-doffer in accordance with the present invention is preferably accompanied with a full roll drive unit 300 which is involved in positive rotation drive of a full roll FR transferred to the full roll station C on the carriage (see FIG. 3).

Even after a full roll FR is transferred to the full roll station C on the carriage, the loom continues its running for production of a cloth. In order to avoid stagnation of the cloth in the area between the loom and the carriage, the full roll FR on the full roll station C must be rotated for positive take up of the cloth connected to the cloth being woven. For smooth rotation drive of the full roll FR to this end, a driven gear on the full roll side must be brought into meshing engagement with a drive gear on the full roll station side without any danger of teeth interference. The full roll drive unit 300 is involved in such a smooth transfer of the full roll to the full roll station C on the carriage.

One embodiment of such a full roll drive unit 300 is shown in FIGS. 43 to 46. After receiving a full roll FR at the locking station B in FIG. 3, the arms 2 move rearwards and upwards to a position facing the full roll station C so as to transfer the full roll FR to the full roll station C from a somewhat upper position. During this process, a driven gear on the full roll side is brought into meshing engagement with a drive gear on the station side so that the full roll FR should be driven into rotation by the full roll drive unit 300 to wind up the cloth CL.

Figure 43:
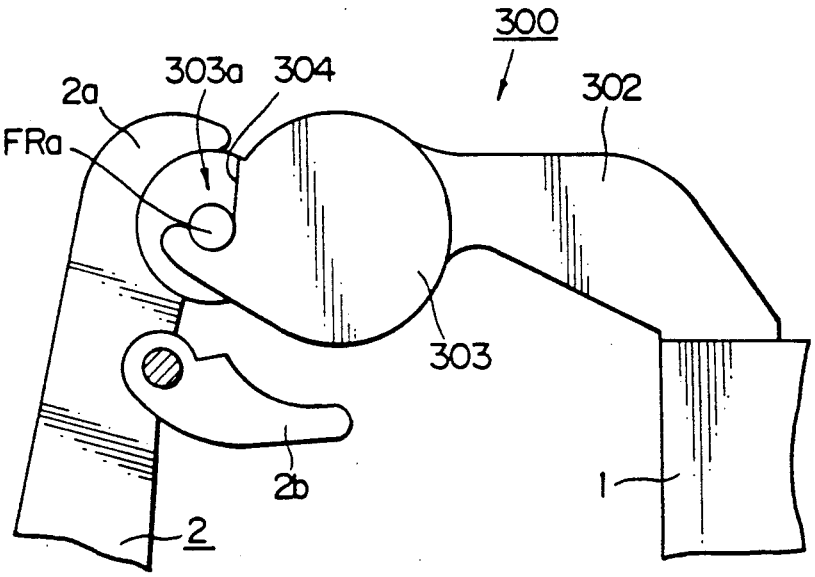
FIG. 43 is a side view of the arm and the full roll station at the moment of full roll transfer.
Figure 44:
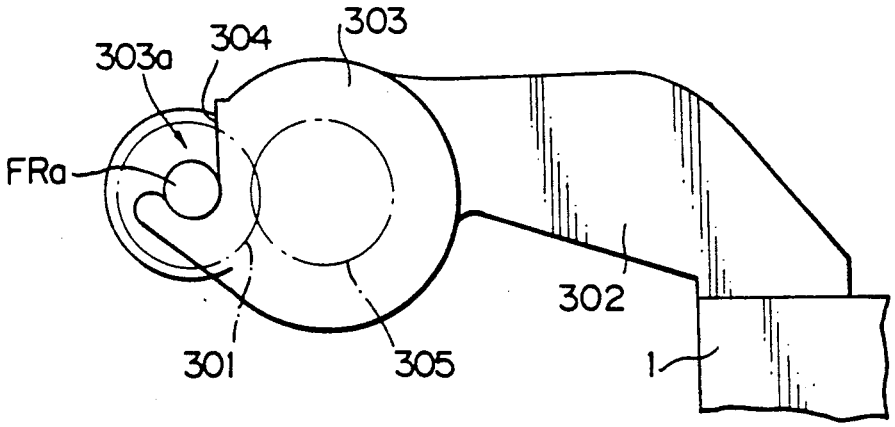
FIGS. 44 and 45 are side and plan views of the full roll drive unit preferably used with the auto-doffer in accordance with the present invention.
Figure 45:
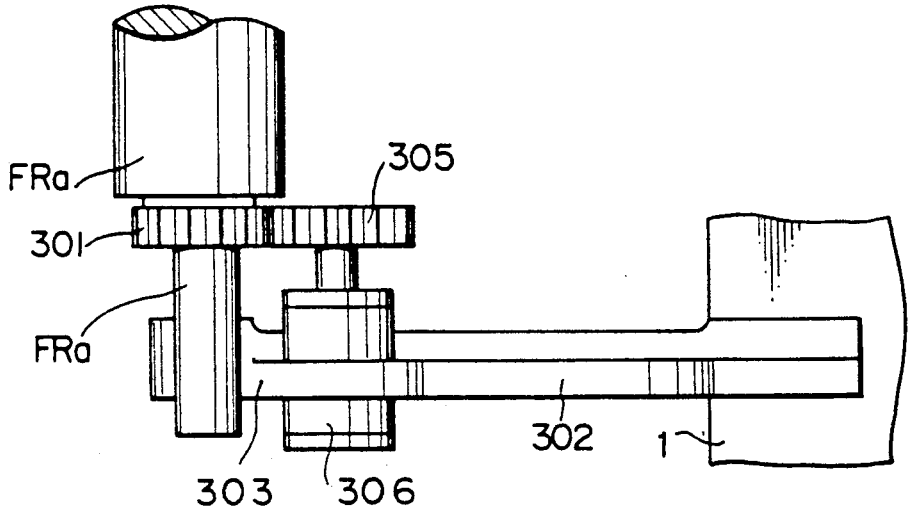

In FIGS. 43 to 45, the driven gear 301 is coaxially secured to the full roll center shaft FRa. A seat block 303 is mounted to the carriage frame 1 by mean of a bracket 302. This seat block 303 is provided with an open seat 303*a* formed in its front face for reception of the full roll center shaft FRa at the time of full roll transfer. A guide wall 304 is formed on the front face of the seat block 303 facing the seat 303*a*. This guide wall 304 has a structure specified later in detail. As a substitute for such a guide wall 304, a proper guide element may be attached to the seat block 303 as long as the element is provided with such a specified guide face.

A drive motor 306 is mounted to the seat block 303 with its output shaft directed in the X-direction. A drive gear 305 is secured to the output shaft of the drive motor 306 in an arrangement such that it should come into meshing engagement with the driven gear 301 when the center shaft FRa is received in the seat 303*a*. When the full roll FR is transferred from the arms 2, its center shaft FRa is guided into the seat 303*a* by the guide wall 304. Concurrently, the driven gear 301 on the center shaft FRa comes into meshing engagement with the drive gear 305 on the output shaft of the drive motor 306 and the full roll FR is driven into rotation.

Figure 46:
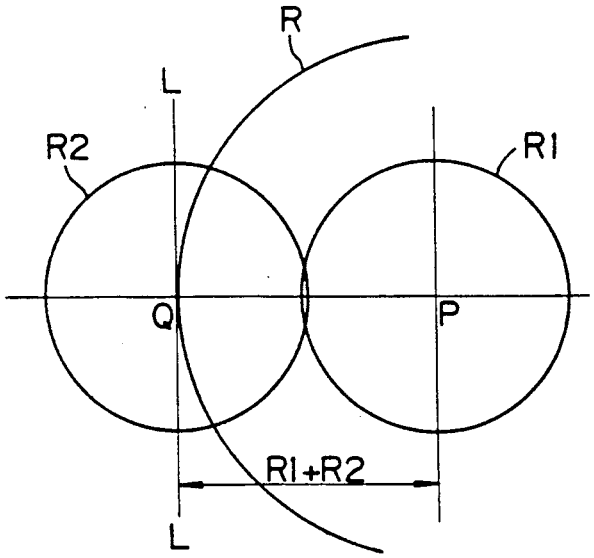
FIG. 46 is a schematic view illustrating how smooth engagement is attained between the driven and the drive gears of the full roll drive unit of FIGS. 44 and 45.

In the process of engagement of the driven gear 301 with the drive gear 305, interference of teeth of the gears should be absolutely avoided in order to cause no damage of the teeth. One example of such an expedient is shown in FIG. 46 in which R1 indicates the radius of the pitch circle of the drive gear 305 and R2 indicates that of the driven gear 301. R indicates a circle which has a radius equal to (R1+R2) and the center at the center P of the drive gear 305. The circle R passes through the center Q of the driven gear 301. For attaining a smooth engagement, the driven gear 301 is required to move towards the drive gear 305 along a path defined by a tangent L of the circle R at the point of the center Q. To say the least, the driven gear 301 needs to move along this path at a moment just before the engagement with the drive gear 305.

In order to meet this requirement, it is possible to move the arms 2 along such a path. In practice, however, a complicated design is necessary to make the arm 2 exactly follow such a locus. In order to avoid this trouble, in the present invention the guide wall 304 is constructed so as to extend substantially in parallel to the above-described tangent L. As the full roll center shaft FRa moves along such a guide wall 304, the driven gear 301 is quite smoothly brought into meshing engagement with the drive gear 305 without any danger of interference of teeth. Thus no complicated design of the arm movement is required to this end.

Lock Unit 600

A lock unit for a roll is generally provided on a loom and is involved in fixing the position of an empty or full roll transferred to the loom. Such a lock unit is not a part of an auto-doffer in general. However the lock unit described below well cooperates with the auto-doffer in accordance with the present invention.

Figure 47:
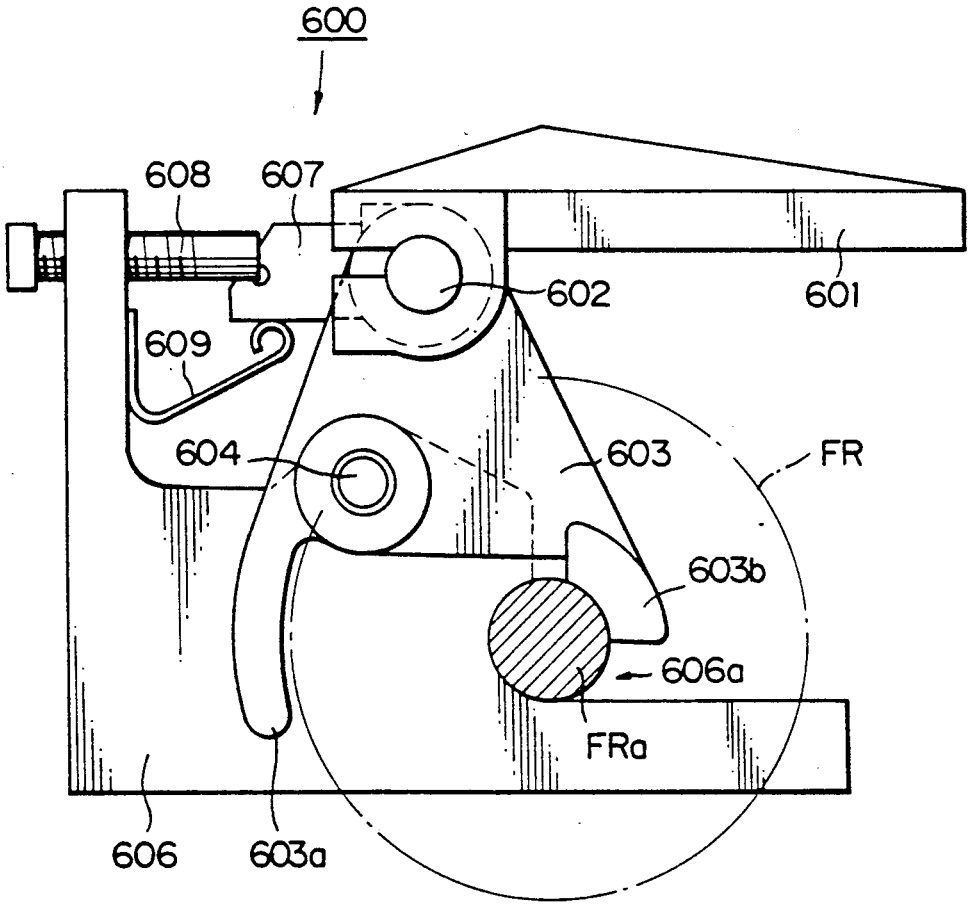
FIG. 47 is a side view of one embodiment of the lock unit of a loom preferably used in combination with the auto-doffer in accordance with the present invention.
Figure 48:
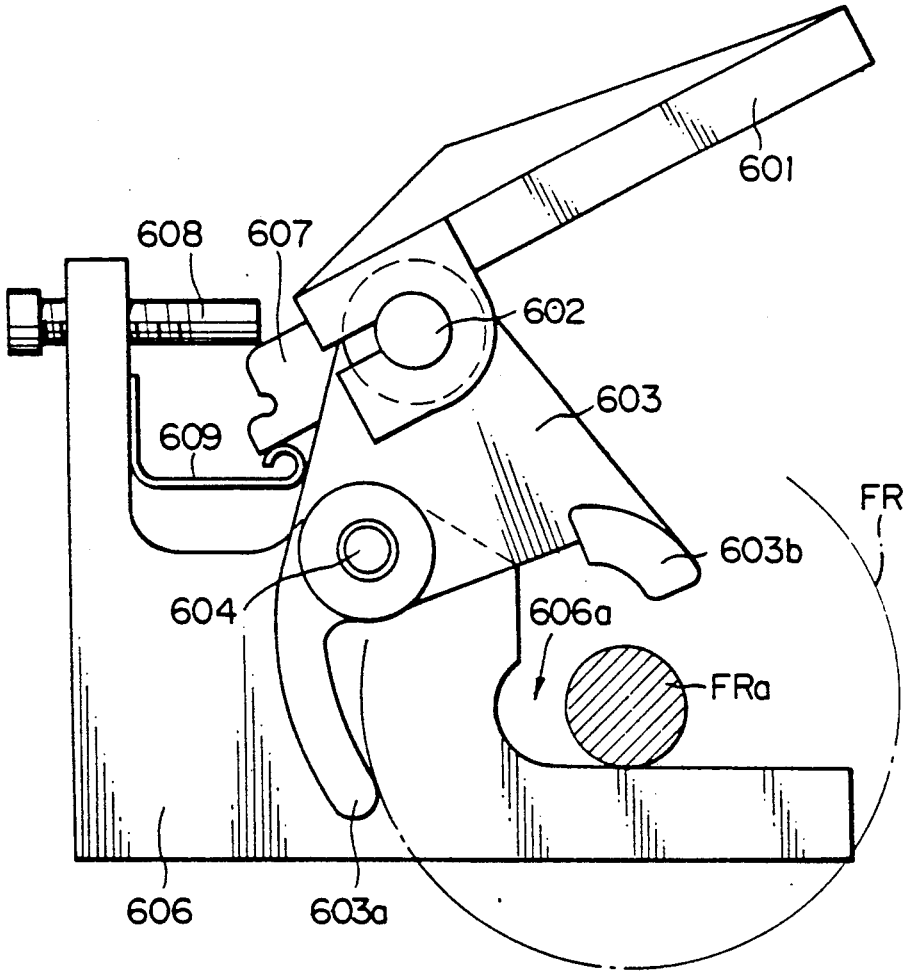
FIG. 48 is a side view of the lock unit in FIG. 47 out of operation.

One embodiment of such a lock unit is shown in FIGS. 47 and 48, in which a base 606 fixed to a frame of a loom (not shown) securely carries a support shaft 604 extending in the width direction of the loom. This direction meets the X-direction when the auto-doffer in accordance with the present invention stops in front of the loom. This support shaft 604 swingably carries a holder 603 which 603 is roughly triangular in shape. Near its rearward and downward corner the holder 603 is monolithically provided with a push out nose 603*a* which projects downwards for engagement with the peripheral face of a full roll FR as later described in more detail. Further, near its forward and downward corner, the holder 603 is provided with a bearing piece 603*b* which is used for engagement with the center shaft FRa of the full roll FR. A support shaft 602 is rotatably mounted to the top end of the holder 603. An arm 601 is secured to this support shaft 602 at its proximal end whilst extending forwards, i.e. towards the auto-doffer stopping in front of the loom. Next to the arm 601 is fixed a locker piece 607 to the support shaft 602. A stop rod 608 is mounted to the base 606 facing the rear side of the arm 601 and the locker piece 607. In the case of the illustrated example, the stop rod 608 is screwed to the base 606 for adjustment of its position. At a position somewhat below the stop rod 608, a biasing element 609 is fixed at its one end to the base 606. The other end of the biasing element 609 is kept in contact with the lower face of the locker piece 607. In the case of the illustrated example, the biasing element is given in the form of a leaf spring.

Under the illustrated condition, the locker piece 607 is held in engagement with the stop rod 608 and, as a consequence, the holder 603 is locked against swing about the support shaft 604. In this position of the holder 603, the full roll center shaft FRa is accommodated in the roll seat 606*a* of the base 606 and held firmly by the bearing piece 603*b*. As long as no external force is applied to cancel the engagement of the locker piece 607 with the stop rod 608, this locked condition is maintained.

At the time of transfer of the full roll FR to the arms 2 of the auto-doffer, the arm 601 of the lock unit 600 is pushed up as shown in FIG. 48 either manually or through contact with the fingers 2*a* and 2*b* of the arms 2. Following this swing of the arm 601, the locker piece 607 swings downwards, i.e. counterclockwise in the illustration, again the force by the biasing element 609. As a result, the locker piece 607 is released from engagement with the stop rod 608. Next, due to the force acting on the locker piece 607 by the biasing element 609, further swing of the locker piece 607 about the support shaft 602 is barred and lifting of the arm 601 forces the holder 602 to swing counterclockwise about the support shaft 604. Thereupon the bearing piece 603*b* of the holder moves upwards to free the full roll center shaft FRa. Concurrently, corresponding counterclockwise movement of the push out nose 603*a* pushes the full roll FR forwards. Then the full roll center shaft FRa is driven out of the roll seat 606*a* so that the full roll FR should be moved towards the arms 2 of the auto-doffer.

In the way described, the swing of the holder 603 caused by lifting of the arm 601 automatically push out the full roll FR from the locking station B. Under this condition, the locker piece 607 is clamped between the stop rod 608 and the biasing element 609 in order keep the position of the holder 603 at discharge of the full roll FR. The stop rod 608, the biasing element 609 and the locker piece 607 form a provisional holding assembly for the holder 603.

At the time of transfer of an empty roll ER to the loom, the empty roll is moved towards the roll seat 606*a* of the base 606 either manually or through movement of the arms 2. Due to contact with the peripheral face of the empty roll, the bearing piece 603*b* is pushed rearwards and the holder 603 is automatically driven to swing in the clockwise direction. Then the force by the biasing element 609 forces the locker piece 607 to again come into engagement with the stop rod 608, thereby locking the entire construction. Concurrently, the center shaft of the empty roll ER is received in the roll seat 606*a* and held firmly by the bearing piece 603*b*.

Figure 49:
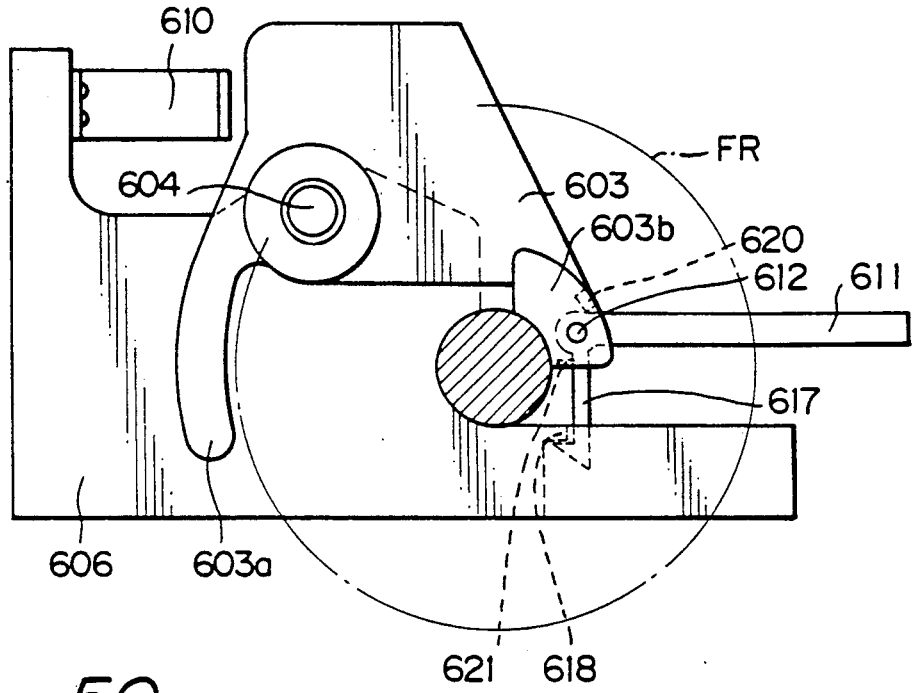
FIGS. 49 and 50 are side views of another embodiment of the lock unit.
Figure 50:
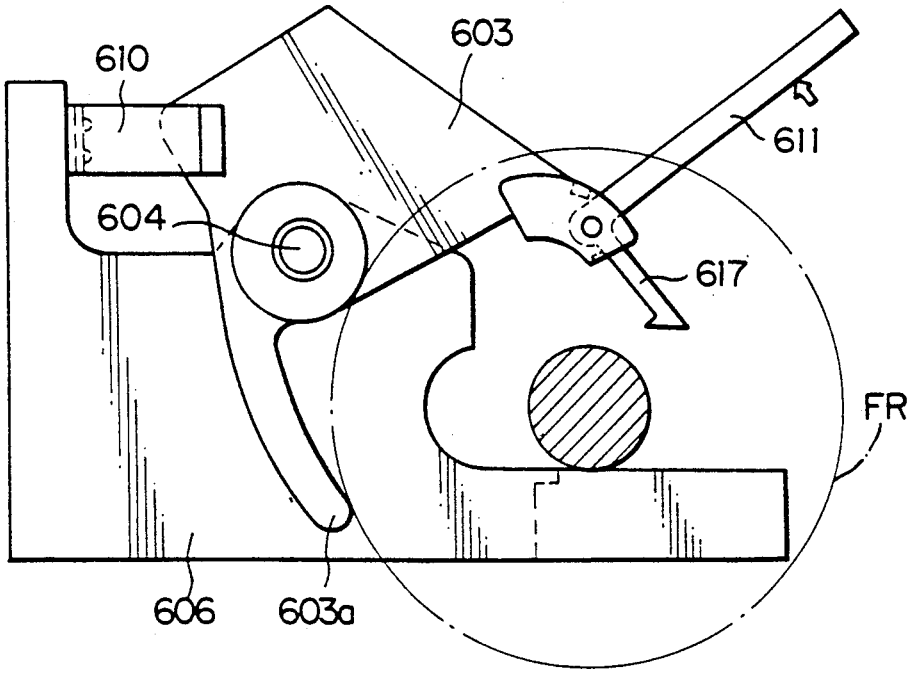
Figure 51:
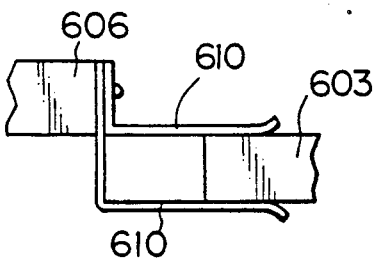
FIG. 51 is a plan view of a part of the lock unit shown in FIGS. 49 and 50.

Another embodiment of the lock unit 600 is shown in FIGS. 49 to 51. In this case, an arm 611 is formed in one body with a locker piece 617 and pivoted to a support shaft 612 mounted to the bearing piece 603*b* on the holder 603. The locker piece 617 in this embodiment is brought into engagement with a stop nose 618 formed on the base 606 to limit swing of the holder 603. When the arm 611 is pushed up as shown in FIG. 50, the locker piece 617 is released from engagement with the stop nose 618. As the arm 611 abuts the first stopper 620 formed on the holder 603, the holder 603 is driven for counterclockwise swing about the support shaft 604 to lift the bearing piece 603*b*. Concurrently the push out nose 603 is moved forwards to push out the full roll FR from the locking station B. As shown in FIG. 51, the holder 693 is clamped by a holding assembly 610 mounted to the base 606 to keep its potion after the swing. At this moment, the locker piece 617 is kept in engagement with the second stopper 621 formed on the holder 603. Transfer of an empty roll can be carried out in a reverse order of operation.

As is clear from the foregoing description, use of the push out nose 603*a* in combination with the bearing piece 603*b* of the holder 603 greatly simplifies discharge of the full roll and reception of the empty roll.

For smooth transfer of an empty roll ER from the arms 2 of the auto-doffer to the locking unit 600 on the loom, it is required to provide the arms 2 with a highly accurate movement. In practice, however, it is very difficult to control the movement of the arm so precisely. Thus, the empty roll is often subjected to strong shocks which tends to disturb its smooth transfer. It is thus strongly wanted that transfer of the empty roll can be carried out free of trouble even when the movement of the arms lacks in some extent of accuracy. In order to meet this requirement, the auto-doffer in accordance with the present invention is preferably provided with a roll insert unit attached to the arms.

Figure 52:
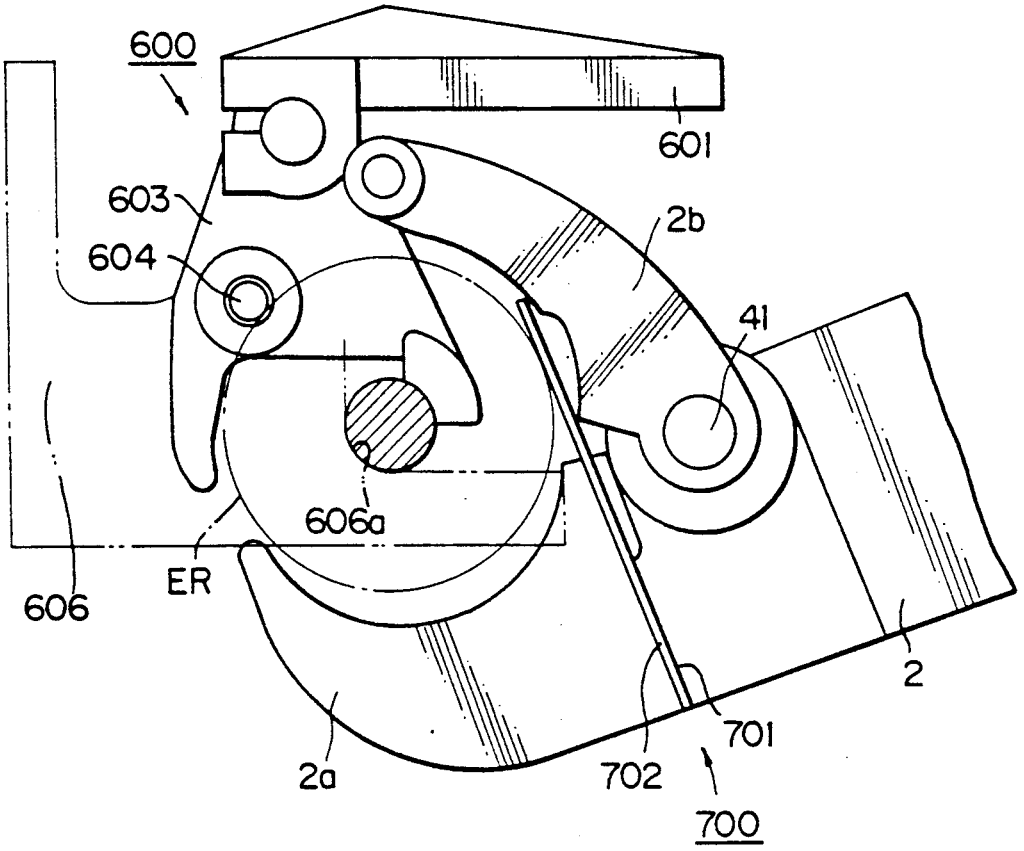
FIG. 52 is a side view of one embodiment of the roll insert unit preferably used for the auto-doffer in accordance with the present invention.

One embodiment of such a roll insert unit 700 is shown in FIG. 52, in which a step 701 is formed on the arm 2 at a position somewhat forward of the support pin 41 for the movable finger 2*b* while extending in a direction normal to the longitudinal direction of the arm 2 and an elastic plate 702 is secured to the step 701 facing a space defined by the fingers 2*a* and 2*b*. At transfer of an empty roll ER to the locking unit 600, the elastic plate 702 abuts the peripheral face of the empty roll ER to push the empty roll center shaft toward the roll seat 606*a* of the lock unit 600. At this moment, the push out nose 603*a* on the holder 603 is also pushed via the empty roll ER so that the force by the biasing element 609 should re-establish the engagement of the locker piece 607 with the stop rod 608 to lock the entire construction. The elastic nature of the elastic plate 702 spans the gap caused by inaccurate movement of the arms 2.

When the auto-doffer in accordance with the present invention is employed in a weaving mill, it is necessary to transport cloth rolls between looms and a cloth roll stocker. More specifically, after termination of the doffing operation, a full roll must be transported from a loom involved in doffing to a stocker arranged within or outside the mill and an empty roll must be transported from such a stocker to a loom in need of next doffing operation. Conventionally, for example in a system disclosed in Japanese Patent Opening Sho. 62-215403, an auto-doffer is involved in both of the doffing of cloth roll and the transportation of cloth roll. That is, doffing cannot be started when the auto-doffer is involved in the transportation. When the doffing operation needs to be carried out at a loom during transportation of cloth roll, running of the loom has to be interrupted until termination of the transportation. Such an interruption greatly lowers production efficiency of the loom. In addition, such an interruption tends to develop a stop mark, i.e. a weaving defect, which seriously mars the quality of cloth.

In order to avoid this problem the number of the auto-doffers may be increased, thereby decreasing the number of looms that each auto-doffer is responsible for. Increase in number of auto-doffer in an automatized mill, however, results in aggravation in safety of the working environment. Furthermore, complicated mill management is required to well control a large number of auto-doffers without accident.

Figure 53:
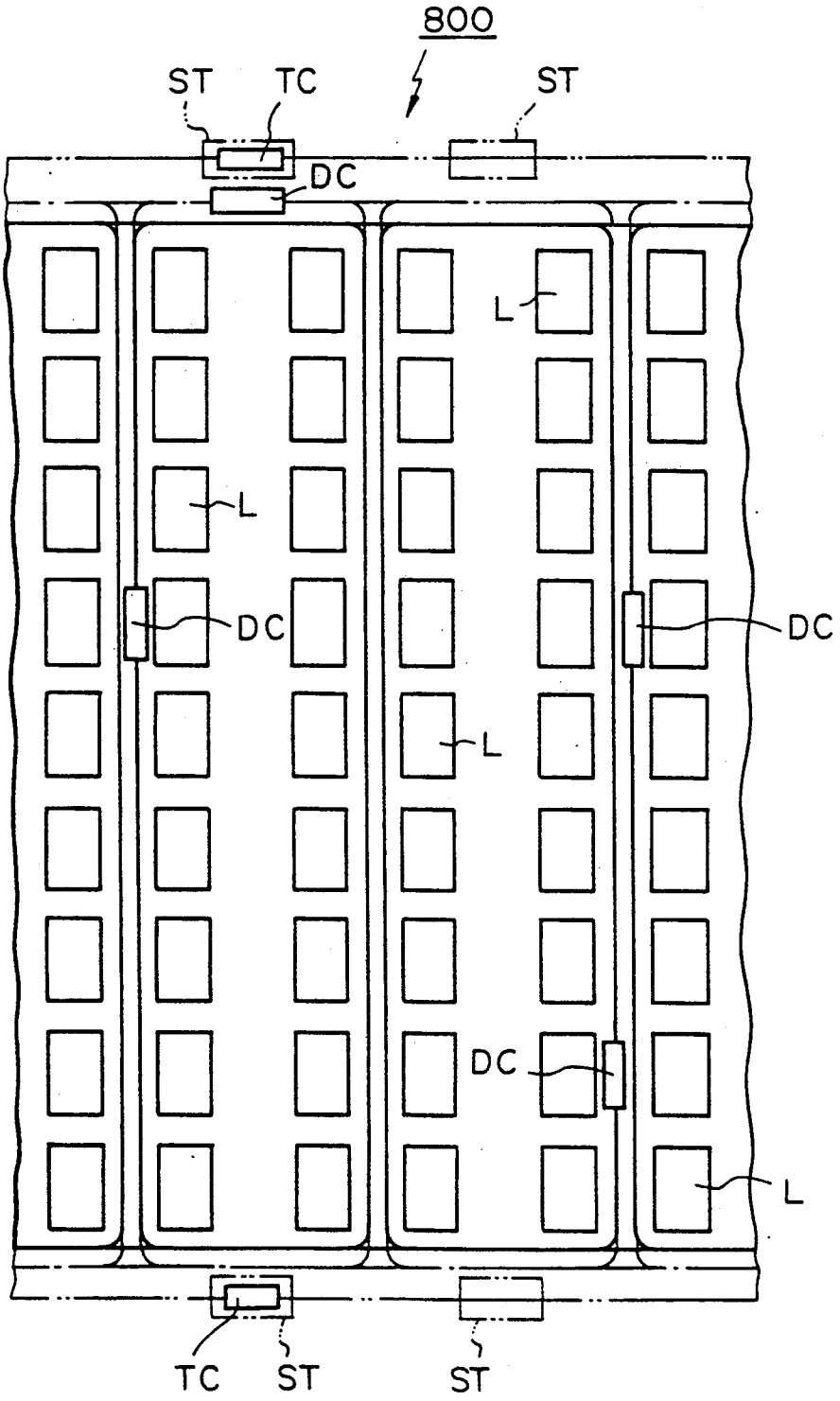
FIG. 53 is a plan view of one embodiment of the weaving system in a mill in which the auto-doffers in accordance with the present invention are used.

One embodiment of the weaving system 800 using the auto-doffer in accordance with the present invention is shown in FIG. 53, in which a number of looms L are arranged in several parallel, spaced arrays. In the case of the illustrated example, 4 auto-doffers DC travel along paths shown with solid lines in the drawing along the arrays of looms L and, each auto-doffer DC runs to a loom L in need of doffing operation on receipt of a command from the central processing unit 104 shown in FIG. 12. After termination of the doffing operation the auto-doffer DC carrying a full roll runs to one of the stations ST whereat a transporter TC carrying an empty roll is standing-by. On arrival at the station ST, transfer of the cloth rolls is carried out between the auto-doffer DC and the transporter TC. Thereafter, the auto-doffer DC restarts its regular travel along the prescribed path and the transporter TC travels to the stocker for transfer of full and empty rolls.

In the case of the illustrated example, the stations ST are located on the sides of the arrays of the looms L for free work of mill operators. Depending of the mill condition, the stations may be arranged in different designs. Traveling paths of the auto-doffers DC and the transporter TC can also be changed freely depending on the mill conditions. The numbers of the auto-doffers DC and the transporter TC are not limited to the illustrated ones.

Figure 54A:
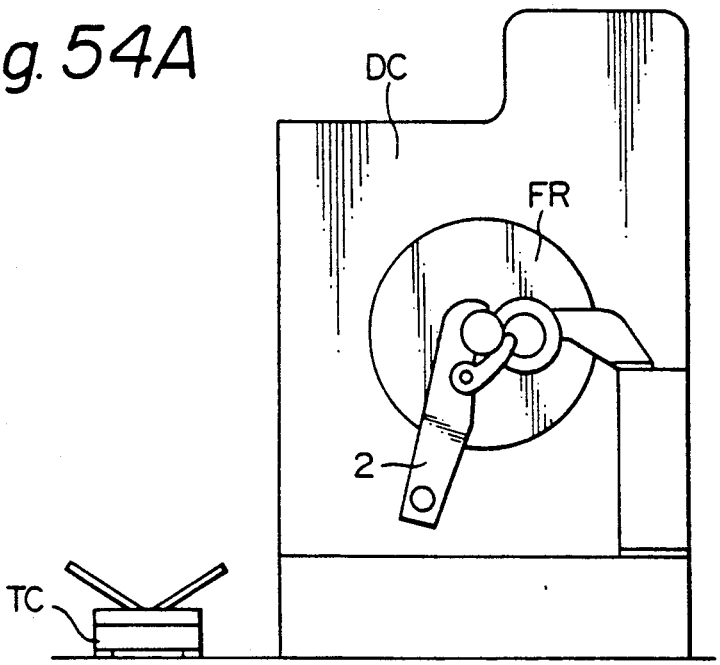
FIG. 54A to 54C are side views of one example of the underground type transporter used for the system shown in FIG. 53.
Figure 54B:
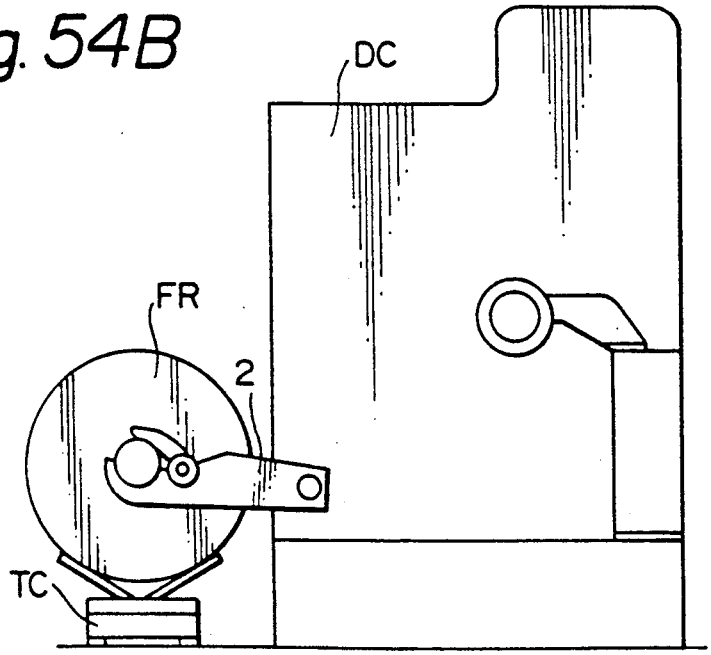
Figure 54C:
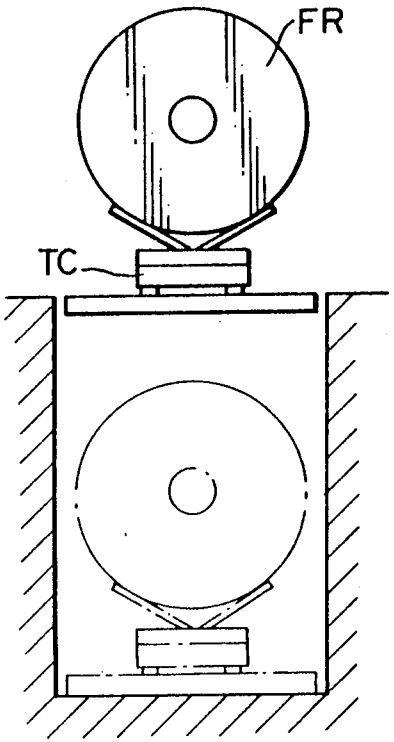

One example of an underground type transporter TC is shown in FIGS. 54A to 54C. As an auto-doffer DC arrives at a station ST where a transporter TC is waiting as shown in FIG. 54A, the arms 2 of the auto-doffer DC transfers a full roll FR to the transporter TC as shown in FIG. 54B. A lifter is arranged at this station ST as shown in FIG. 54C to bring down the transporter TC carrying the full roll FR to an underground passage as shown with chain lines. The transporter TC travels to a given stocker along this underground passage.

Figure 55:
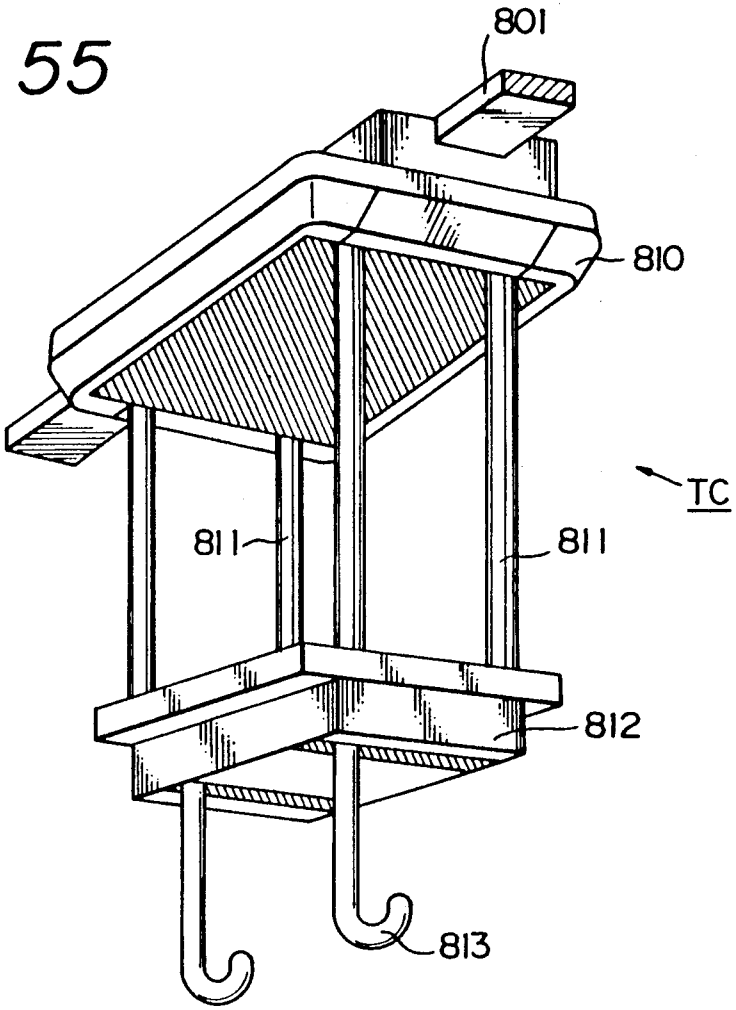
FIG. 55 is a perspective view of an overhead type transporter used for the system shown in FIG. 53.

One example of an overhead type transporter TC is shown in FIG. 55, in which a main body 81 travels along an overhead guide rail 801. This main body carries four posts 811 telescopically projecting downwards to support a holder 812. The holder is provided with at least two hangers 813 movable in the width direction of transporter TC. By combination of the vertical movement of the holder 812 with the lateral movement of the hangers 813, transfer of cloth roll with the auto-doffer is carried out.

We claim:

1. An auto-doffer for performing a doffing operation at a loom in a weaving mill, comprising:

a carriage, a main shaft arranged on said carriage and extending horizontally with respect to said carriage in an X-direction, a pair of arms mounted radially to said main shaft and each provided with a pair of cooperative fingers adapted for holding a roll, an arm drive unit mounted to said carriage in mechanical coupling with said arms to cause three dimensional movements of said arms, said arm drive unit including a Z-drive assembly mounted on the carriage for moving each said arm in a Z-direction, a Y-drive assembly mounted on the carriage for moving each said arm in a Y-direction, an X-drive assembly mounted on the carriage for moving each said arm in said X-direction and a finger control assembly for opening and closing said fingers of each said arm, said Z-direction being a horizontal direction perpendicular to said X-direction and said Y-direction being a vertical direction perpendicular to said X-direction and said Z-direction, a cloth presser unit mounted to said carriage and provided with a presser element adapted for pressing a cloth onto an empty roll positioned in a loom, and a cutter unit mounted to said carriage and provided with a cutter for cutting said cloth in the width direction between said empty roll and a full roll.

2. An auto-doffer as claimed in claim 1 in which said Z-drive assembly includes a connecting beam mounted to said carriage such as to be movable horizontally in said Z-direction together with said main shaft, a transmission shaft axially rotatably mounted to said connecting beam and extending horizontally substantially in said X-direction, at least one pinion fixed to said transmission shaft, a rack fixed on said carriage in meshing engagement with said pinion and extending horizontally in said Z-direction, and means for driving said transmission shaft into axial rotation.

3. An auto-doffer as claimed in claim 1 in which said Y-drive assembly includes a connecting beam mounted to said carriage such as to be movable horizontally in said Z-direction together with said main shaft, and means mounted to said connecting beam for driving said main shaft into axial rotation.

4. An auto-doffer as claimed in claim 1 in which said X-drive assembly includes a connecting beam mounted to said carriage such as to be movable horizontally in said Z-direction together with said main shaft, at least one threaded end formed at one end of said main shaft, a gear screwed over said threaded end, and means mounted to said connecting beam for driving said gear into axial rotation.

5. An auto-doffer as claimed in claim 1 in which said finger control assembly includes a horizontal pin rotatably mounted to each said arm and firmly holding one of said fingers in a radial direction, and means mounted to said arm for driving said pin into axial rotation.

6. An auto-doffer as claimed in claim 1 further comprising an arm movement adjuster unit mounted to said carriage to adjust at least one of said three dimensional movements in reference to a difference between predetermined carriage and loom reference points in at least one of said X-, Y- and Z-Directions.

7. An auto-doffer as claimed in claim 6 in which said arm movement adjuster unit includes at least one non-contact type detector mounted to said carriage and directed in one of said X-, Y- and Z-Directions and a central processing unit which is connected to said detector to generate a command signal corresponding to said difference between said carriage and loom reference points detected by said detector.

8. An auto-doffer for performing a doffing operation at a loom in a weaving mill, comprising:

a carriage, a main shaft arranged on said carriage and extending horizontally with respect to said carriage in an X-direction, a pair of arms mounted radially to said main shaft and each provided with a pair of cooperative fingers adapted for holding a roll, an arm drive unit mounted to said carriage in mechanical coupling with said arms to cause three dimensional movements of said arms, a cloth presser unit mounted to said carriage and provided with a presser element adapted for pressing a cloth onto an empty roll positioned in a loom, and a cutter unit mounted to said carriage and provided with a cutter for cutting said cloth in the width direction between said empty roll and a full roll, and an empty roll doffing unit arranged on said carriage for transferring an empty roll to said arms, said empty roll doffing unit including a horizontal support shaft rotatably mounted to said carriage above said arms and extending in said X-direction, a holder plate mounted radially to said support shaft and provided with a pair of monolithic walls spaced apart from each other at their distal ends, means for driving said support shaft into axial rotation, and a vertical guide wall secured to said carriage such as to be facing said holder plate.

9. An auto-doffer for performing a doffing operation at a loom in a weaving mill, comprising:

a carriage, a main shaft arranged on said carriage and extending horizontally with respect to said carriage in an X-direction, a pair of arms mounted radially to said main shaft and each provided with a pair of cooperative fingers adapted for holding a roll, an arm drive unit mounted to said carriage in mechanical coupling with said arms to cause three dimensional movements of said arms, a cloth presser unit mounted to said carriage and provided with a presser element adapted for pressing a cloth onto an empty roll positioned in a loom, said cloth presser unit including a pair of arms which are swingably mounted to said carriage such as to extend in a direction normal to the axis of said main shaft, first means for driving said arms into a swing motion in a Y-direction, and second means for driving said arms into a movement in a Z-direction, and said presser element being held between distal ends of said arms and extending in an X-direction, said Z-direction being a horizontal direction perpendicular to said X-direction and said Y-direction being a vertical direction perpendicular to said X-direction and said Z-direction, and a cutter unit mounted to said carriage and provided with a cutter for cutting said cloth in the width direction between said empty roll and a full roll.

10. An auto-doffer as claimed in claim 9 in which said first driving means includes a clutch.

11. An auto-doffer as claimed in claim 12 in which said clutch is a torque clutch.

12. An auto-doffer as claimed in claim 9 in which said presser element is a press roll held by said arms in an axially rotatable arrangement.

13. An auto-doffer as claimed in claim 9 in which said presser element is a press bar.

14. An auto-doffer as claimed in claim 9 further comprising a wind detector unit for detecting the presence of at least one complete wind of a cloth on said empty roll within a prescribed period after initial winding by said cloth pressor unit.

15. An auto-doffer as claimed in claim 14 in which said wind detector unit includes rotation sensors attached to an empty roll shaft and a drive shaft, respectively, and a signal processing circuit electrically connected to said rotation sensors for generating an alert signal when a gap in rotation is not detected via said rotation sensors within a prescribed period after initial winding by said cloth pressor unit.

16. An auto-doffer as claimed in claim 14 in which said wind detector unit includes a sensor arranged near said empty roll and a signal processing circuit which is electrically connected to said sensor and generates an alert signal when no presence of said at least one wind within said prescribed period is detected by said sensor.

17. An auto-doffer as claimed in claim 16 in which said sensor is a limit switch for detecting a displacement of a roller kept in rolling contact with said empty roll.

18. An auto-doffer as claimed in claim 17 in which said roller is a press roller arranged on said loom.

19. An auto-doffer as claimed in claim 16 in which said sensor is a photoelectric sensor.

20. An auto-doffer as claimed in claim 19 in which said photoelectric sensor is directed towards the peripheral surface of said empty roll, and presence of the first one complete wind of said cloth is detected by said photoelectric sensor.

21. An auto-doffer as claimed in claim 19 in which said photoelectric sensor is directed towards one selvage of said cloth wound about said empty roll, and presence of a prescribed number of winds of said cloth is detected by said said photoelectric sensor.

22. An auto-doffer for performing a doffing operation at a loom in a weaving mill, comprising:

a carriage, a main shaft arranged on said carriage and extending horizontally with respect to said carriage in an X-direction, a pair of arms mounted radially to said main shaft and each provided with a pair of cooperative fingers adapted for holding a roll, an arm drive unit mounted to said carriage in mechanical coupling with said arms to cause three dimensional movements of said arms, a cloth presser unit mounted to said carriage and provided with a presser element adapted for pressing a cloth onto an empty roll positioned in a loom, and a cutter unit mounted to said carriage, said cutter unit including a cutter block mounted to said cloth presser unit, a pair of parallel tension bars mounted to said cutter block so as to be spaced from each other in a Z-direction horizontally perpendicular to said X-direction and extending in said X-direction, a cutter mounted to said cutter block between said tension bars with its blade being directed in said X-direction, and means mounted to said cloth presser unit for reciprocating said cutter block in said X-direction and provided with a cutter for cutting said cloth in the width direction between said empty roll and a full roll.

23. An auto-doffer as claimed in claim 22 in which the distal end of one said tension bar is curved in one Y-direction and the distal end of the other said tension bar is curved in the other Y-direction, said Y-direction being vertically perpendicular to said X-direction and said Z-direction.

24. An auto-doffer as claimed in claim 22 in which the distal ends of said tension bars are curved in one Y-direction.

25. An auto-doffer as claimed in claim 22 further comprising a cut detector unit accompanying said cutter unit for generating an alert signal if the cutting operation by said cutter unit is not performed in accordance with predetermined criteria.

26. An auto-doffer as claimed in claim 25 in which said cut detector unit includes means for setting a prescribed period which generates a first signal after passage of said prescribed period from receipt of a command signal indicative of start of movement of said cutter, means for detecting arrival of said cutter to generate a second signal, and means for comparing said two signals to generate an alert signal when said first signal is received but said second signal is not received after said prescribed period.

27. An auto-doffer as claimed in claim 26 in which said detecting means detects said arrival of said cutter via a position of said cutter.

28. An auto-doffer as claimed in claim 26 in which said detecting means detects said arrival of said cutter via a displacement of said cutter.

29. An auto-doffer as claimed in claim 25 in which said cut detector unit includes means for setting a prescribed period which generates a first signal after passage of said prescribed period from receipt of a command signal indicative of start of movement of said cutter, means for detecting a load on a full roll drive motor to generate a second signal, and means for comparing said two signals to generate an alert signal when said first signal is received but said second signal is not received after said prescribed period.

30. An auto-Doffer as claimed in claim 29 in which said detecting means detects said load on said drive motor via an electric current supplied to said drive motor.

31. An auto-doffer as claimed in claim 29 in which said detecting means detects said load on said drive motor via a torque acting on said drive motor.

32. An auto-doffer as claimed in claim 25 in which said cut detector unit includes means for setting a prescribed period which generates a first signal after passage of said prescribed period from receipt of a command signal indicative of start of movement of said cutter, means for detecting a force acting on said presser element to generate a second signal, and means for comparing said two signals to generate an alert signal when said first signal is received but said second signal is not received after said prescribed period.

33. An auto-doffer as claimed in claim 32 in which said detecting means detects said force acting on said presser element via detecting a load on a drive motor for said presser element.

34. An auto-doffer as claimed in claim 32 in which said detecting means detects said force acting on said pressor element via a position of said pressor element.

35. An auto-doffer as claimed in claim 25 in which said cut detector unit includes means for detecting a force acting on said cutter to generate a first signal, means for setting a reference force to act on said cutter during the cutting operation to generate a corresponding second signal, and means for comparing said two signals to generate an alert signal when said first signal exceeds said second signal.

36. An auto-doffer as claimed in claim 35 in which said detecting means includes a presser sensor.

37. An auto-doffer as claimed in claim 25 in which said cut detector unit includes means for detecting a driving force for moving said cutter to generate a first signal, means for setting a reference driving force necessary for moving said cutter during the cutting operation to generate a corresponding second signal, and means for comparing said two signals to generate an alert signal when the value of said first signal exceeds the value of said second signal.

38. An auto-doffer as claimed in claim 37 in which said detecting means detects said driving force via electric current supplied to a drive motor for said cutter.

39. An auto-doffer as claimed in claim 37 in which said detecting means detects said driving force via torque of a drive motor for said cutter.

40. An auto-doffer as claimed in claim 21 in which said cut detector unit includes means for detecting a moving speed of said cutter to generate a first signal, means for setting a reference moving speed of said cutter during normal cutting operation to generate a corresponding second signal, first means for comparing said first signal with said second signal to generate a third signal when the value of said first signal falls short of the value of said second signal, means for setting a first prescribed period to generate a fourth signal over a second prescribed period after passage of said first signal over a second prescribed period after passage of said first prescribed period from receipt of a command signal indicative of start of movement of said cutter, and second means for comparing said third signal with said fourth signal to generate an alert signal when said third signal is received during input of said fourth signal.

41. An auto-doffer as claimed in claim 40 in which said detecting means includes a tacho-generater.

42. An auto-doffer as claimed in claim 40 in which said detecting means includes an encoder and a timer for setting a unit period.

43. An auto-doffer for performing a doffing operation at a loom in a weaving mill, comprising:

a carriage, a main shaft arranged on said carriage and extending horizontally with respect to said carriage, a pair of arms mounted radially to said main shaft and each provided with a pair of cooperative fingers adapted for holding a roll, an arm drive unit mounted to said carriage in mechanical coupling with said arms to cause three dimensional movements of said arms, a cloth presser unit mounted to said carriage and provided with a presser element adapted for pressing a cloth onto an empty roll positioned in a loom, a cutter unit mounted to said carriage and provided with a cutter for cutting said cloth in the width direction between said empty roll and a full roll, and a full roll drive unit mounted to said carriage for driving said full roll into rotation after transfer to said carriage from said loom, said full roll drive unit including a seat block secured to said carriage and provided with an open seat adapted for receiving a center shaft of said full roll, a drive gear coupled to a drive motor mounted to said seat block for engagement with a driven gear secured to said center shaft of said full roll, and a guide wall formed on said seat block facing said seat, said guide wall extending substantially in parallel to a tangent of a circle having its center at the center of said drive gear and passing through the center of said driven gear, said circle having a radius equal to the sum of the radii of the pitch circles of said driven and drive gears.

44. An auto-doffer for performing a doffing operation at a loom in a weaving mill, comprising:

a carriage, a main shaft arranged on said carriage and extending horizontally with respect to said carriage, a pair of arms mounted radially to said main shaft and each provided with a pair of cooperative fingers adapted for holding a roll, an arm drive unit mounted to said carriage in mechanical coupling with said arms to cause three dimensional movements of said arms, a cloth presser unit mounted to said carriage and provided with a presser element adapted for pressing a cloth onto an empty roll positioned in a loom, a cutter unit mounted to said carriage and provided with a cutter for cutting said cloth in the width direction between said empty roll and a full roll, and a roll insert unit mounted to said arms to guide a roll at transfer from said arms to said loom.

45. An auto-doffer as claimed in claim 44 in which said roll insert unit includes an elastic plate mounted to said arm facing a space defined by said fingers.

46. Apparatus for transferring rolls to and from looms in a weaving mill, comprising:

A. an auto-doffer, said auto-doffer including (i) a carriage, (ii) a main shaft arranged on said carriage and extending horizontally with respect to said carriage, (iii) a pair of arms mounted radially to said main shaft and each provided with a pair of co-operative fingers adapted for holding a roll, (iv) an arm drive unit mounted to said carriage in mechanical coupling with said arms to cause three dimensional movements of said arms, (v) a cloth presser unit mounted to said carriage and provided with a presser element adapted for pressing a cloth onto an empty roll positioned in a loom, and (vi) a cutter unit mounted to said carriage and provided with a cutter for cutting said cloth in the width direction between said empty roll and a full roll; and B. A lock unit for each loom for facilitating transfer of a roll to and from said auto-doffer, said lock unit including (i) a base on the loom, (ii) a holder mounted to said base in an arrangement swingable in a direction normal to the width direction of said loom and provided with a push out nose for engagement with a cloth roll, a bearing piece for firm holding of a center shaft of said cloth roll, and a holder projecting forwards, (iii) a locking assembly coupled to said holder arm to limit said swing of said holder depending the position of said holder arm, and (iv) a holding assembly mounted to said base to hold said holder at a prescribed swing position.

* * * * *